United States Patent [19]

Hosoi

[11] Patent Number: 4,658,780

[45] Date of Patent: Apr. 21, 1987

[54] FOUR CYCLE INTERNAL COMBUSTION ENGINE

[75] Inventor: Yukiharu Hosoi, Shizuoka, Japan

[73] Assignee: Yamaha Hatsudoki Kabushiki Kaisha, Iwata, Japan

[21] Appl. No.: 704,155

[22] Filed: Feb. 22, 1985

Related U.S. Application Data

[63] Continuation of Ser. No. 374,276, May 3, 1982, abandoned.

[30] Foreign Application Priority Data

| | | | |
|---|---|---|---|
| May 8, 1981 | [JP] | Japan | 56-69099 |
| May 8, 1981 | [JP] | Japan | 56-69100 |
| May 11, 1981 | [JP] | Japan | 56-70331 |
| May 11, 1981 | [JP] | Japan | 56-70332 |
| Sep. 8, 1981 | [JP] | Japan | 56-141430 |

[51] Int. Cl.[4] ..... F02B 15/00

[52] U.S. Cl. ..... 123/315; 123/90.22; 123/432

[58] Field of Search ..... 123/90.22, 90.48, 308, 123/309, 310, 315, 193 H, 188 M, 432

[56] References Cited

U.S. PATENT DOCUMENTS

| | | | |
|---|---|---|---|
| 26,603 | 6/1859 | Seggern et al. | 123/308 |
| 1,231,546 | 6/1917 | Giddings | 123/315 |
| 1,257,142 | 2/1918 | Sorg | 123/308 |
| 1,555,991 | 10/1925 | Konar | 123/308 |
| 1,631,410 | 6/1927 | Fornaca | 123/90.27 |
| 2,318,914 | 5/1943 | Anderson et al. | 123/308 |
| 2,385,959 | 10/1945 | Yingling | 123/90.22 |
| 3,021,826 | 2/1962 | DeFezzy et al. | 123/90.36 |
| 3,125,075 | 3/1964 | Wittek | 123/308 |
| 3,211,137 | 10/1965 | Love | 123/432 |
| 3,318,292 | 5/1967 | Hideg | 123/308 |
| 3,633,556 | 1/1972 | Inoue | 123/90.22 |
| 3,898,966 | 8/1975 | List | 123/308 |
| 4,007,716 | 2/1977 | Jones | 123/90.48 |
| 4,116,180 | 9/1978 | Hayashi et al. | 123/310 |
| 4,211,189 | 7/1980 | Hamai | 123/308 |
| 4,246,874 | 1/1981 | Nakagawa et al. | 123/308 |
| 4,350,126 | 9/1982 | Honda | 123/308 |

FOREIGN PATENT DOCUMENTS

| | | | |
|---|---|---|---|
| 3009302 | 9/1980 | Fed. Rep. of Germany | 123/432 |
| 814385 | 6/1936 | France . | |
| 1264423 | 8/1961 | France | 123/308 |
| 53-20568 | of 1978 | Japan . | |
| 296125 | of 1928 | United Kingdom . | |
| 431144 | of 1934 | United Kingdom . | |
| 687528 | 2/1953 | United Kingdom | 123/315 |
| 1431152 | 4/1976 | United Kingdom | 123/432 |

*Primary Examiner*—Craig R. Feinberg
*Assistant Examiner*—David A. Okonsky
*Attorney, Agent, or Firm*—Ernest A. Beutler

[57] ABSTRACT

A four cycle internal combustion engine has a cylinder, a piston slidable therein, intake and exhaust valves, a pair of intake passages, and an exhaust passage. There are at least three intake valves, and the intake passages are connected so that each discharges to an intake valve adjacent to the central axis of the cylinder, and in addition also to respective other intake valves on the opposite sides of an axis of symmetry. The plural intake valves, and if desired also the plural exhaust valves, are simultaneously activated because they are connected to a respective plate that is contacted by an actuating cam. The respective valve stems are inclined in a V shaped configuration to accommodate a plug between them, and a central one of the valves can be offset (advanced) into the combustion chamber to improve the combustion characteristics.

15 Claims, 25 Drawing Figures

FOUR CYCLE INTERNAL COMBUSTION ENGINE

This application is a continuation of application Ser. No. 374,276, filed May 3, 1982 now abandoned.

FIELD OF THE INVENTION

This invention relates to four-cycle internal combustion engines, and in particular to improvements in the intake and exhaust valving system, and in the intake and exhaust conduitry systems for such engines, and especially to such an engine which includes three or more intake valves per cylinder.

BACKGROUND OF THE INVENTION

In an engine according to the prior art, as customary, an ignition plug is disposed in the vicinity of the bore center of the cylinder, and intake and exhaust valves are arranged to straddle the ignition plug. The intake and exhaust valves have large diameters so as to enlarge the effective areas for the intake and exhaust. In case the ignition plug is disposed in the vicinity of the bore center of the cylinder, the valve or valves have its or their one-side inner wall or walls extending close to the inner circumference of the cylinder. Especially in the case of the intake valve, the flow of intake air is then blocked by the inner circumference of the cylinder so that a kind of masking effect results to increase the resistance to the intake air flow. It is, therefore, conceivable to provide a plurality of intake valves. However, if the ignition plug is left in the vicinity of the bore center of the cylinder, the aforementioned masking effect still remains adversely to affect the intake air flow. If the number of the intake valves is increased, on the other hand, it becomes difficult to make room for mounting the ignition plug.

A feature of the present invention has been conceived in view of the background thus far described with the objective of providing a four-cycle engine which has each cylinder equipped with at least three intake valves and in which the said masking effect is reduced so that the intake air may smoothly flow into the combustion chamber, while there is still adequate room for mounting an ignition plug.

In order to achieve the above objective, the present invention is constructed such that one intake valve is arranged in the vicinity of the bore center of a cylinder, and an ignition plug is arranged in the vicinity of an axis extending through the bore center of said cylinder, such that the remaining intake valves are arranged at one side of said axis whereas an exhaust valve is arranged at the other side of said axis, and all of said intake valves and said exhaust valves are inclined so that their respective valve stem ends are spaced from a plane which extends through said axis and in parallel with said cylinder.

Furthermore, in order to enlarge the effective area of the intake passage of an intake valve, it has earlier been conceived to provide a plurality of intake valves and a plurality of intake passages. Especially when three or more intake valves are provided, it is difficult in a practical cylinder head to provide independent communications between the plurality of intake valves and a like number of intake passages. It is, therefore, conceivable to supply intake air from two intake passages into the three or more intake valves. In this instance, generally speaking, the flow of the intake air is liable to become irregular. For example, in case one intake passage communicates with two of the three valves whereas the other intake passage communicates with the remaining valve, a difference is established in the flow rate of the intake air which fluctuates in accordance with changes in the r.p.m. of the engine, thereby remarkably to change the combustion state. This makes it difficult to ensure a smooth run from low to high speeds. On the other hand, in case, for example, two intake valves are disposed on a bore center axis extending through the bore center of the cylinder, whereas the remaining intake valves are arranged symmetrically with respect to that bore center axis, two intake passages fail to have an identical curvature if they are separately made to communicate with the two intake valves on the bore center axis. Due to this difference in the curvature, the flow rates of the intake air through the respective intake passages also become irregular to invite the disadvantage that the running operation fails to become smooth for changes in the engine r.p.m.

A feature of the present invention has been conceived in view of the background thus far described and as an objective an intake system for a four-cycle engine of the type in which each cylinder is equipped with at least three intake valves, and in which at least one of said intake valves is arranged in the vicinity of a bore center axis extending through the bore center of said cylinder whereas the remaining intake valves are arranged symmetrically with respect to said bore center axis, said intake system being enabled to ensure a smooth running operation from low to high speeds by smoothening the flow of intake air, thereby to make uniform the flow rate of the intake air to be supplied to the respective intake valves.

In order to achieve the above objective, the cylinder includes two intake passages that are formed generally symmetrically with respect to the above defined bore center axis and are made to communicate with both the intake valves, which are positioned at the same side thereof, and the intake valve is arranged in the vicinity of said bore center axis.

Also, it has been suggested to equip one cylinder with a plurality of valves for an intake system and/or an exhaust system thereby to reduce the intake and/or exhaust resistances. Then the plural valves are arranged in parallel with each other or one another and are simultaneously opened and closed by the use of a rocker arm or a valve lifter. In case a rocker arm is used, the weight of the moving parts such as the rocker arm is increased to invite the disadvantage that the valve actuating mechanism fails to be appropriate for a high speed running operaiton.

If a valve lifter is used, as previously suggested, cylindrical valve lifters are independently attached to the respective valves, and the cam shaft is formed with a plurality of cams which are independently held in sliding contact with respective valve lifters. As a result, the sum of the weights of the moving parts also increases until the valve actuating mechanism is not suitable for high speed running operation, and the formation of multiple cams on the cam shaft increases the number of machining steps. In this case, moreover, in order to retain a space for arranging the respective valve lifters, the gaps between the two adjacent valves cannot be narrowed and as a consequence there is another disadvantage, namely that the design of the valve arrangement is restricted.

In the known methods using valve lifters it is necessary to arrange the valves parallel to the corresponding cam shaft, and the valve stem ends of the respective valves are disposed one-dimensionally below the cam shaft. Therefore, in case the valve stem ends of the respective valves are arranged two-dimensionally with respect to the corresponding cam shaft, i.e., in case the valve stem ends are offset in a plurality of directions relative to the cam shaft, it has been impossible to use conventional valve lifters.

The feature of the present invention has been conceived in view of the background thus far described and has as an objective to provide a valve actuating mechanism for use with an overhead cam shaft type engine, in which the weight of moving parts is reduced to make a high speed running operation possible, to reduce the number of cams on a cam shaft, to freely set the gaps between any two adjacent valves, and to arrange the valve stem ends of the respective valves two-dimensionally with respect to the corresponding cam shaft.

In order to achieve this objective, there is provided a valve actuating mechanism for an overhead cam shaft type engine which has one cylinder equipped with a plurality of parallel valves for at least either of its intake and exhaust systems, said valve actuating mechanism being constructed to comprise: valve springs for biasing the plural valves in directions to be closed; valve lifters so held in a cylinder head that they can slide in the same directions of said valves; thrust plates sandwiched between said valve lifters and the respective valve stem ends of said plural valves and made movable together with said valve lifters; and cam shafts for thrusting said valve lifters toward said valves, whereby said plural valves are simultaneously opened and closed by said thrust plates.

Yet another feature of the present invention relates to a valve actuating mechanism for use with an overhead cam shaft type engine, which mechanism is equipped with a plurality of parallel valves for at least either of an intake system or an exhaust system.

Yet another optional feature of the invention is concerned with inclining three or more intake valves for each cylinder parallel to one another, and in an identical direction with respect to the cylinder and simultaneously opening and closing all of the intake valves by the use of a single valve lifter or a single thrust plate. In this instance, however, if the intake valves used have the same valve stem length so as to make the parts of the respective valves common, the combustion chamber becomes deeper especially in the vicinity of the bore center to reduce the compression ratio but to increase the S/V ratio (i.e., the ratio of the surface area to the volume of the combustion chamber) thereby to reduce the efficiency of the engine. Moreover, since a large step is formed in the inner wall of the combustion chamber, the combustion is liable to become irregular thereby to make it difficult to run the engine with a lean air-fuel mixture. This results in disadvantages that the fuel economy is deteriorated, and that the measures for the exhaust emission control are handicapped.

On the other hand, if the intake valve in the vicinity of the bore center is located deep in the combustion chamber, it becomes necessary to dispose the exhaust valve adjacent thereto at a shallow place in the combustion chamber to raise the compression ratio as much as possible. In this instance, the thickness at the cylinder head side, which is required to hold the valve seat of the exhaust valve is reduced and risks deformation of the valve seat by thermal strain. There arises yet another problem, that the durability in the vicinity of the valve seat is reduced.

The feature of the invention has been conceived in view of those disadvantages thus far described and has an objective to provide a cylinder head for use with a four-cycle internal combustion engine of the type in which at least three intake valves for each cylinder are disposed parallel to one another and at an inclination with respect to the cylinder, and in which one of the aforementioned intake valves is arranged in the vicinity of the bore center of the aforementioned cylinder, said cylinder head being enabled to increase the compression ratio, to reduce the S/V ratio, to improve the fuel economy and the exhaust emission and to prevent the thermal deformation of the valve seats while improving the durability of the same.

In order to achieve the above-specified objective, the engine is constructed such that according to this feature the valve seat of the intake valve in the vicinity of the bore center is more offset inwardly of a combustion chamber in parallel with the corresponding valve stem than the valve seats of the remaining intake valves, thereby to make the aforementioned combustion chamber shallower in the vicinity of the bore center.

DETAILED DESCRIPTION OF THE INVENTION

Figure 1:
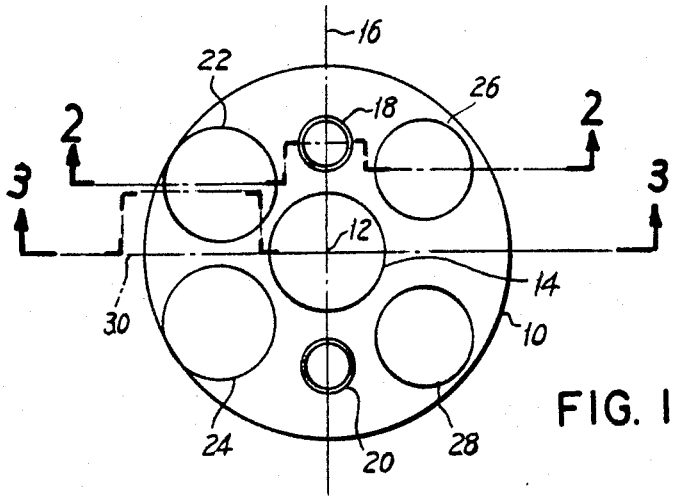
FIG. 1 is a top plan schematic view of one embodiment of the invention.

In FIG. 1, reference numerals 10 and 12 indicate a cylinder and the bore center of this cylinder 10, respectively. An intake valve 14 is arranged at that bore center 12. Numeral 16 indicates an axis which extends through that bore center 12 and on which two ignition plugs 18 and 20 are arranged while interposing the intake valve 14 between them. In addition to the aforementioned intake valve 14 at the center, the present invention is equipped with two additional intake valves 22 and 24 which are positioned at one side of the axis 16 (viewed looking down along the cylinder axis). Numerals 26 and 28 indicate exhaust valves, which are positioned at the other side of the axis 16. The respective ignition plugs 18 and 20, the respective intake valves 22 and 24 and the respective exhaust valves 26 and 28 are positioned in symmetry with respect to an axis of symmetry 30, which extends through the bore center 12 and intersects the axis 16.

Figure 2:
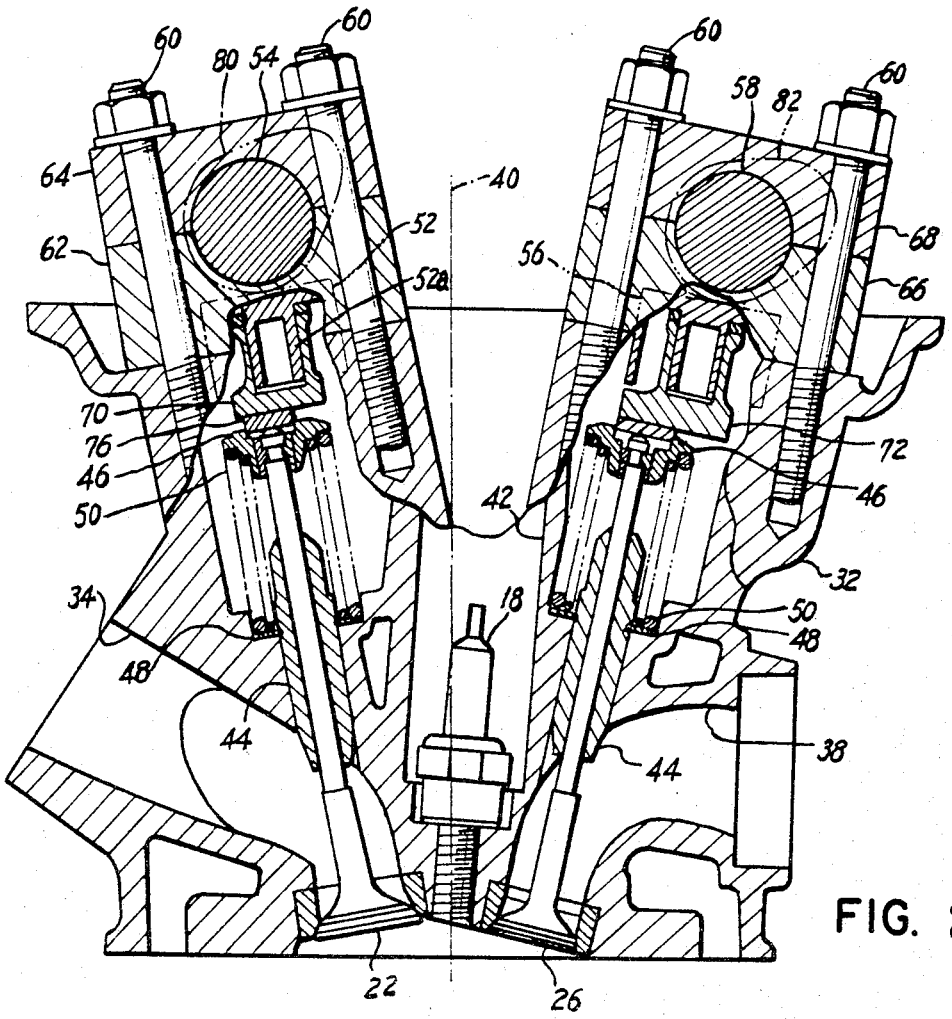
FIGS. 2 and 3 are cross-sections taken at lines 2—2 and 3—3, respectively, in FIG. 1.
Figure 3:
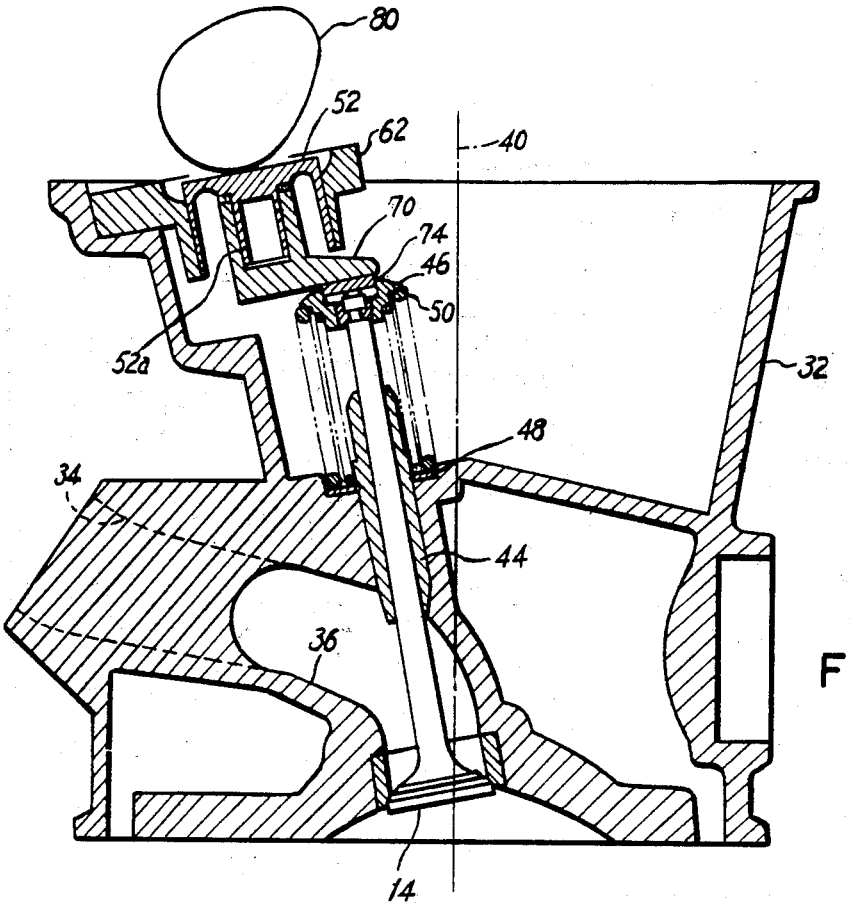

In FIGS. 2 and 3, numeral 32 indicates a cylinder head. This cylinder head 32 is formed with two intake passages 34 and 34 (although only one of them appears in the drawings), which communicate with intake valves 22 and 24, and with two intake passages 36 and 36 (although only one of them appears in the drawings) which are branched from the foregoing two intake passages 34 and 34 to communicate with center intake valve 14. With exhaust valves 26 and 28, there independently communicate exhaust passages 38 and 38 (although only one of them appears in the drawings).

Numeral 40 indicates a plane which includes the aforementioned axis 16 (as shown in FIG. 2) and in parallel to the axis of cylinder 10. The aforementioned respective intake valves 14, 22 and 24 and exhaust valves 26 and 28 are so inclined that their valve stems are spaced at their ends (which are located at the upper sides of FIGS. 2 and 3) from plane 40. Specifically, the respective intake valves 14, 22 and 24 have their upper ends inclined leftwardly in FIGS. 2 and 3, whereas the exhaust valves have their upper ends inclined rightwardly in the same Figures. As a result, between intake valves 22 and 24 and exhaust valves 26 and 28, there is formed a generally V-shaped space, in which ignition plugs 18 and 20 are arranged. Numeral 42 appearing in FIG. 2 indicates one of ignition plug guide holes.

The respective valves 14, 22, 24, 26 and 28 are slidably held in respective valve guides 44 and are so biased by retainers 46, which are fixed on the valve stem ends of the respective valves, and by retainers 48 which are retained in the respective valve guides 44, that they may block the communications between intake and exhaust passages 34 and 38 and the combustion chamber. Numerals 52 and 54 indicate a valve lifter and a cam shaft at the intake side, whereas numerals 56 and 58 indicate a valve lifter and a cam shaft at the exhaust side. Cam shafts 54 and 58 are clamped between fitting members 62 and 64 and fitting members 66 and 68, which are fixed to the cylinder head 32 by means of a number of stud bolts 60. Valve lifters 52 and 56 are slidably held in fitting members 62 and 66, respectively, which are in abutment against the cylinder head 32. Numeral 70 indicates one of thrust members which are sandwiched between the valve lifter 52 and the intake valves 14, 22 and 24, whereas numeral 72 indicates one of thrust members which are sandwiched between the valve lifter 56 and the exhaust valves 26 and 28. The respective thrust members 70 and 72 are fitted in center portions **52*a* and 56*a*, which are formed to project from the inner sides of valve lifters 52 and 56. The lower sides of thrust members 70 face the valve stem ends of the three intake valves 14, 22 and 24 through pads 74, 76 and 76, respectively, whereas the lower sides of thrust members 72 face the valve stem ends of the two exhaust valves 26 and 28 through pads 78 and 78, respectively. Only one of pads 76 and 76, and only one of pads 78 and 78, appear in FIGS. 2 and 3. Against the upper sides of the valve lifters 52 and 56, there abut cams 80 and 82 which are formed on cam shafts 54 and 58**, respectively.

The operations of the present embodiment will now be described. When cam shafts 54 and 58 rotate at a speed as high as one half of the crankshaft (although not shown) so that cams 80 and 82 are rotated by cam shafts 54 and 58, cams 80 and 82 thrust downward the valve lifters 52 and 56, respectively, in accordance with predetermined suction and exhaust timings. As a result, valve lifters 52 and 56 and thrust members 70 and 72 are moved downward. At this time, the three intake valves 14, 22 and 24 are simultaneously opened by thrust members 70, and the two exhaust valves 26 and 28 are simultaneously opened by thrust members 72.

Since intake valve 14 is disposed at the bore center 12, the intake air that flows from valve 14 into the combustion chamber is not blocked by the inner circumference of the cylinder 10, and it can therefore smoothly flow. In other words, there arises no masking effect which might otherwise be caused by the inner circumference of the cylinder 10.

Figure 4:
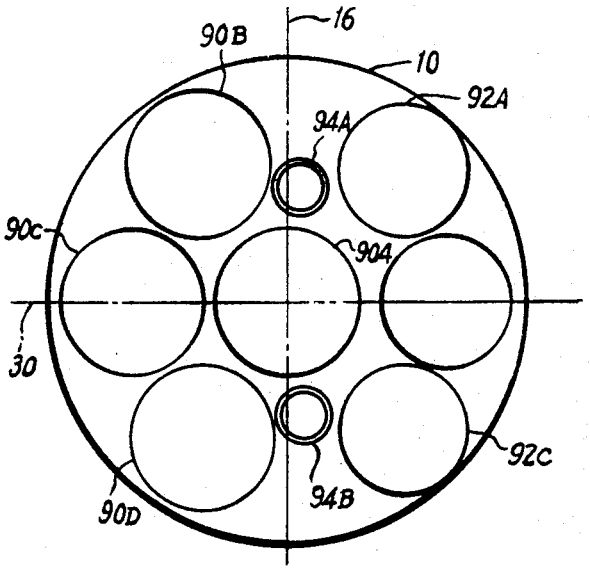
FIGS. 4 and 5 are views similar to FIG. 1 of other embodiments of the invention.
Figure 5:
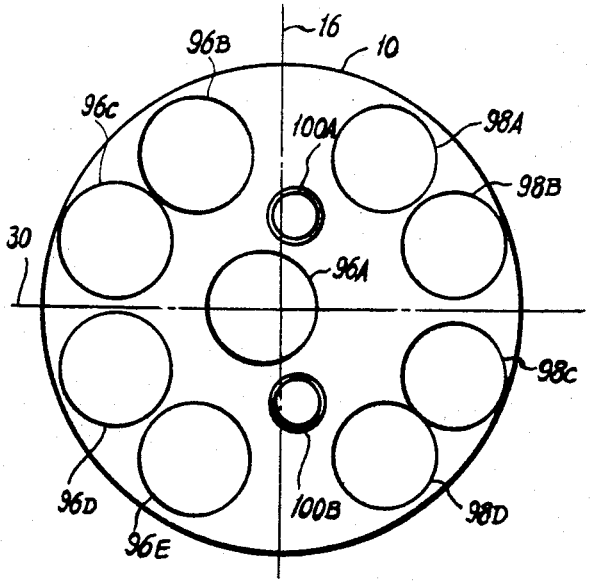

FIGS. 4 and 5 are views showing the arrangements of the valves and ignition plugs according to other embodiments. The embodiment of FIG. 4 is equipped with four intake valves 90A to 90D and three exhaust valves 92A to 92C, of which the center intake valve 90A is positioned at the bore center 12. Moreover, ignition plugs 94A and 94B are slightly offset from axis 16. Ignition plugs 94A and 94B, intake valves 90A to 90D and exhaust valves 92A to 92C are arranged in symmetry with the axis of symmetry 30.

The embodiment of FIG. 5 is equipped with five intake valves 96A to 96E and four exhaust valves 98A to 98D and with two ignition plugs 100A and 100B. Intake valve 96A is slightly offset on axis of symmetry 30 from bore center 12 toward the remaining intake valves 96B to 96E but is made symmetrical as a whole with respect to axis of symmetry 30.

In the embodiments of FIGS. 4 and 5, the respective intake valves 90A to 90D and 96A to 96E and the respective exhaust valves 92A to 92C and 98A to 98D are inclined similarly to those of FIG. 3 to generally form spaces of the letter "V" shape in which ignition plugs 94A and 94B, and 100A and 100B are arranged, respectively.

Although, in the respective embodiments thus far described, the two ignition plugs 18 and 20, 94A and 94B, and 100A and 100B are disposed at the positions interposed in between center intake valves 14, 90A and 96A, respectively, the present invention can naturally attain the desired effects even if one of the paired ignition plugs is dispensed with.

As has been described hereinbefore, according to the present invention, since one of at least three intake valves is arranged in the vicinity of the bore center, the intake air to flow from that center intake valve into the combustion chamber is not blocked by the inner circumference of the cylinder but can smoothly flow thereinto. In other words, no masking effect due to the cylinder inner circumference is caused. As a result, resistance to the flow of intake air can be reduced to improve the charging efficiency, and accordingly the output and fuel economy of the engine. Moreover, the remaining intake valves are arranged at one side of the axis extending through the bore center, whereas all the exhaust valves are arranged at the other side of that axis, and all of the valves are so inclined that the respective intake valves and the respective exhaust valves have their valve stem ends spaced from the plane passing through that axis and parallel to the cylinder axis. As a result, a generally V-shaped space can be provided between all the intake valves and all the exhaust valves. Thus, a sufficient space for mounting the ignition plugs can be reserved at the position which corresponds to the bottom of that V-shaped space, i.e., in the vicinity of the aforementioned axis. Since the ignition plugs are arranged in the vicinity of that axis, according to the present invention, the space necessary for mounting and demounting the ignition plugs can be enlarged to improve the serviceability of the ignition plugs.

Figure 6:
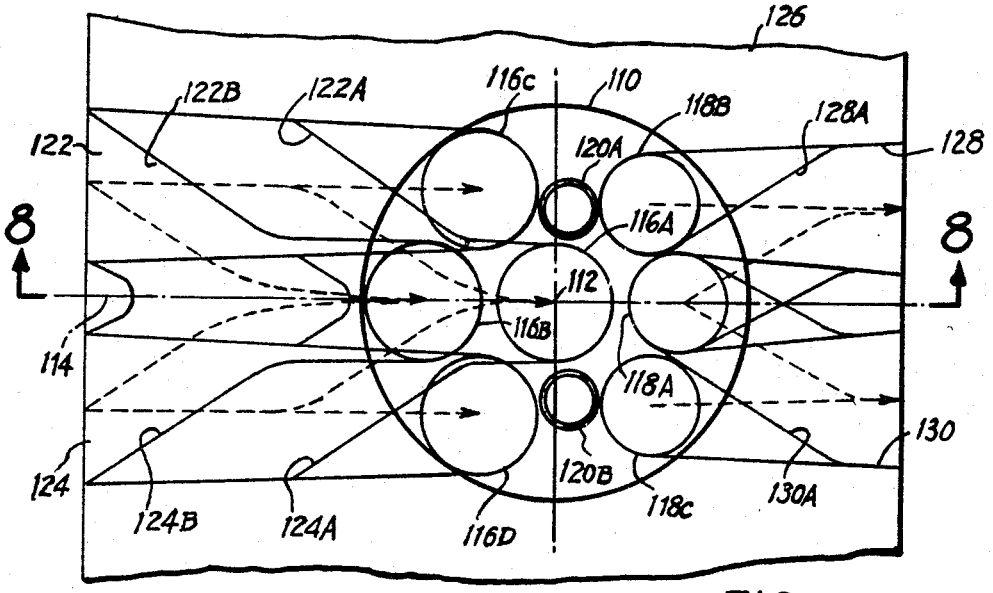
FIG. 6 is a top plan schematic view showing a useful feature of the invention.
Figure 7:
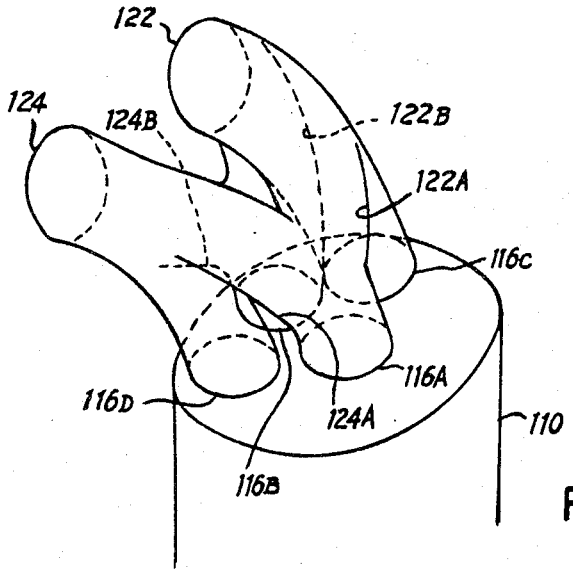
FIG. 7 is a perspective view further illustrating a portion of FIG. 6.
Figure 8:
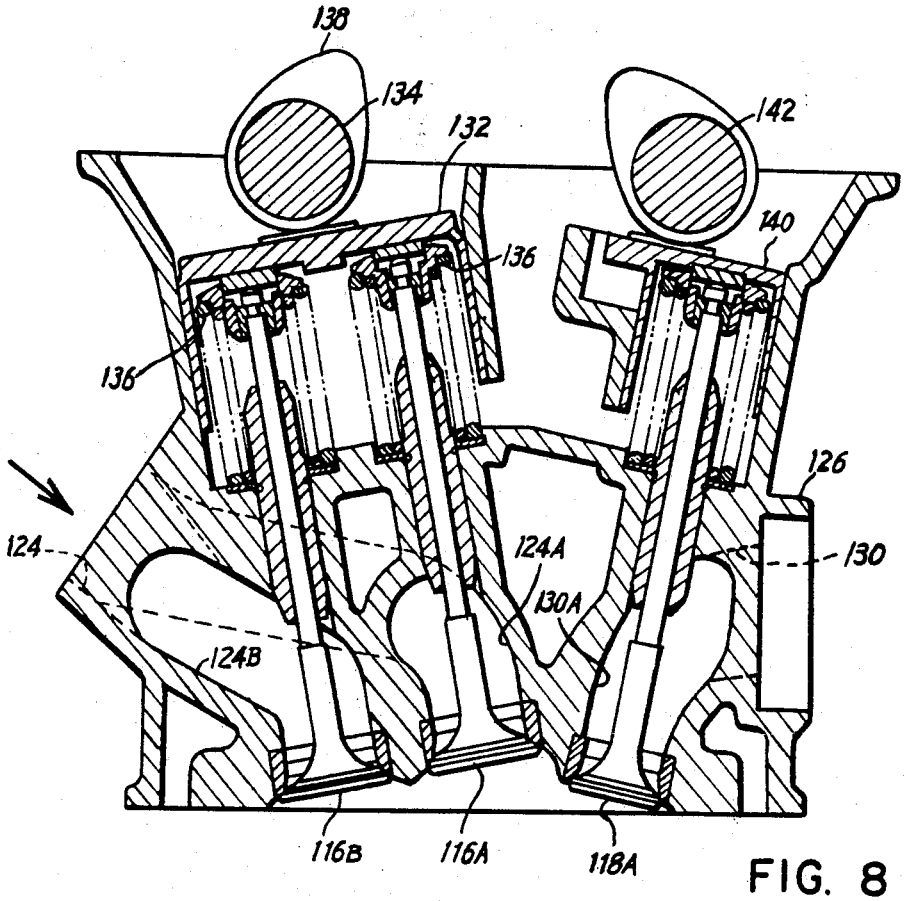
FIG. 8 is a cross-section taken at line 8—8 in FIG. 6.

In FIGS. 6 and 8, another embodiment of the invention is shown. Reference numerals 110 and 112 indicate a cylinder and the bore center of this cylinder 110, respectively. Numeral 114 indicates a bore center axis which extends through bore center 112 while providing an axis of symmetry in the embodiment now being described. Numeral 116 (e.g., 116A to 116D) indicates one of four intake valves, of which intake valve 116A is positioned at bore center 12, and intake valve 116B is positioned on the bore center axis 114. The remaining intake valves 116C and 116D are so positioned as to interpose between valves 116A and 116B on that bore center axis 114. Respective valves 116A to 116D are arranged symmetrically with respect to bore center axis 114. Numeral 118 (e.g., 118A to 118C) indicates exhaust valves, of which exhaust valve 118A is positioned on bore center axis 114 but at the side opposite from the aforementioned intake valve 116B (looking downward along the cylinder axis). Moreover, the remaining exhaust valves 118B and 118C are arranged in a manner to interpose exhaust valve 118A in between and in symmetry with bore center axis 114. Numeral 120 (e.g., 120A and 120B) indicates one of two ignition plugs. Ignition plugs 120A and 120B are arranged in a manner to interpose the aforementioned intake valve 116A in between, and in symmetry with bore center axis 114.

Numerals 122 and 124 indicate intake passages. Intake passages 122 and 124 are so formed in a cylinder head 126 that they are in symmetry with bore center axis 114. Intake passage 122 is made to communicate with intake valve 116C, which is positioned at the same side thereof, and is smoothly branched at its midway into two passages extending in the flow direction of intake air. Branch passages 122A and 122B are made to communicate with intake valves 166A and 116B which are located on bore center axis 114. On the other hand, intake passage 124 is made to communicate with intake valve 116D, which is positioned at the same side thereof, and is smoothly branched at its midway into two passages extending in the flow direction fo intake air. Branch passages 124A and 124B are made to communicate with intake valves 116A and 116B. As a result, intake valves 116A and 116B are supplied with intake air equally from the two intake passages 122 and 124.

Numerals 128 and 130 indicate exhaust passages, which are so formed in cylinder head 126 that they are in symmetry with bore center axis 114. Exhaust passage 128 is made, as best seen in FIG. 6, to communicate with exhaust valve 118B and to merge at its midway into a branch passage 128A for introducing the engine exhaust gas of the exhaust valve 118A on bore center axis 114. The other exhaust passage 130 is also made to communicate with exhaust valve 118C and to merge at its midway into a branch passage 130A for introducing exhaust gas of the exhaust valve 118A.

The four intake valves 116A to 116D are parallel to one another (see FIG. 8) and are inclined toward intake passages 122 and 124. They are opened and closed at one time by the coactions of a single valve lifter 132 and a single cam shaft 134. Specifically, respective valves 116A to 116D are closed by the actions of valve springs 136 (although only two of them appear in FIG. 8), respectively. The valve stem ends of the respective valves 116A to 116D and the valve lifter 132, which is formed to enclose valve springs 136, are so held in the cylinder head 126 that they move in parallel to the moving directions of the respective valves 116A to 116D. As a result, the valve lifter 132 is moved down by the rotations of cams 138 on cam shaft 134, which are brought into sliding contacts with the upper side of valve lifter 132, thereby to open valves 116A to 116D at one time.

The three exhaust valves 118A to 118D are arranged parallel to one another. They are inclined toward the exhaust passages 128 and 130. Similar to the aforementioned intake valves 116A to 116D, exhaust valves 118A to 118C are also opened and closed at one time by the coactions of a single valve lifter 140 and a single cam shaft 142.

Now, at the suction stroke of a piston (although not shown), if valve lifter 132 is thrusted downward, as viewed in FIG. 8, by cams 138 of cam shaft 134, it moves down while thrusting downward the valve stem ends of the respective intake valves 116A to 116D. As a result, intake valves 116A to 116D begin to be opened at one time, whereupon the intake air flows from intake passages 122 and 124 into the combustion chamber. The intake air flows in an independent manner to respective intake valves 116C and 116D, which are spaced from bore center axis 114, from intake passages 122 and 124, respectively, whereas the intake air flows in a merging manner to the respective intake valves 116A and 116B on bore center axis 114, from branch passages 122A and 124A and branch passages 122B and 124B. Since intake passages 122 and 124 are formed in symmetry with bore center axis 114, intake valves 116A and 116B on bore center axis 114 are equally supplied with half flows of intake air from two intake passages 122 and 124, respectively. Specifically, if the effective areas and curvatures of branch passages 122A and 124A and branch passages 122B and 124B are properly selected, all of the intake valves 116A to 116D can always be supplied smoothly with intake air at proper flow rates substantially independently of the r.p.m. of the engine.

At the exhaust stroke of the piston, if valve lifter 140 is thrusted by the cams of cam shaft 142, the respective exhaust valves 118A to 118C can be simultaneously opened. As a result, the flows of the exhaust gas, which have passed through respective exhaust valves 118B and 118C spaced from bore center axis 114, are introduced into different exhaust passages 128 and 130, whereas the exhaust gas flow, which has passed through exhaust valves 118A lying on the bore center axis 114, is shared between the respective branch passages 128A and 130A. These divided exhaust flows are then merged to flow into exhaust passages 128 and 130, respectively, until they are discharged to the atmosphere.

Figure 9:
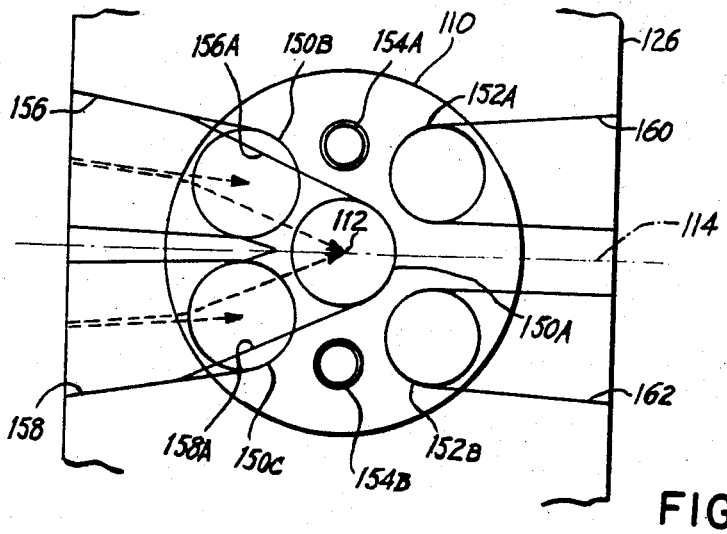
FIGS. 9 and 10 are top plan schematic views showing other useful features of the invention.

FIG. 9 is a view showing a valve arrangement according to another embodiment of the present invention. This further embodiment is equipped with three intake valves 150A to 150C, two exhaust valves 152A and 152B, and two ignition plugs 154A and 154B. Of these, the single intake valve 150A is positioned at bore center 112, whereas the remaining intake valves 150B and 150C, exhaust valves 152A and 152B and ignition plugs 154A and 154B are arranged in symmetry with bore center axis 114. Numerals 156 and 158 indicate intake passages which are formed in symmetry with bore center axis 114. Intake passage 156 is made to communicate with intake valve 150B and is branched smoothly along the flow direction of the intake air. Branch passage 156A communicates with intake valve 150A located at the center. Intake passage 158 is likewise made to communicate with intake valve 150C and is branched smoothly along the intake air flow path. Branch passage 158 communicates with intake valve 150A located at the center. Moreover, exhaust valves 158A and 152B are made to communicate with two exhaust passages 160 and 162 independently of each other.

Since, in the foregoing respective embodiments, a single intake valve 116A or 150A is disposed at the bore center 112, it is spaced apart from the inner circumference of the cylinder. As a result, when intake air is to flow into the combustion chamber from the valve 116A or 150A, its flow is not blocked by the cylinder inner circumference. In other words, a masking effect due to the cylinder inner circumference is not promoted so that the flow of intake air is further smoothened for the improvement in the engine output power. In the foregoing respective embodiments, because two ignition plugs 120A and 120B, or 154A and 154B are provided, ignition of an air-fuel mixture is ensured. However, the present invention can naturally be applied to the case in which only one ignition plug is provided.

As has been described hereinbefore, in connection with the embodiments of FIGS. 6–9, in a four-cycle engine having at least one of its intake valves arranged in the vicinity of the bore center axis and its remaining intake valves arranged substantially in symmetry with that bore center axis, the two intake passages are formed substantially in symmetry with the bore center axis and are made to communicate with both of the intake valves positioned at the same side thereof and with the intake valve positioned on the bore center axis. As a result, the flow rates of intake air to flow through respective intake passages are equalized, and the intake air flows themselves become symmetric with respect to the bore center axis so that the flow rates of the intake air to be supplied to the respective intake valves can be equalized. As a result, the intake air flow fluctuates less as a whole even with changes in the engine r.p.m., so that a smooth running operation can be attained from the low to high running speeds at all times.

FIGS. 10–15 show yet another embodiment of the invention.

Figure 10:
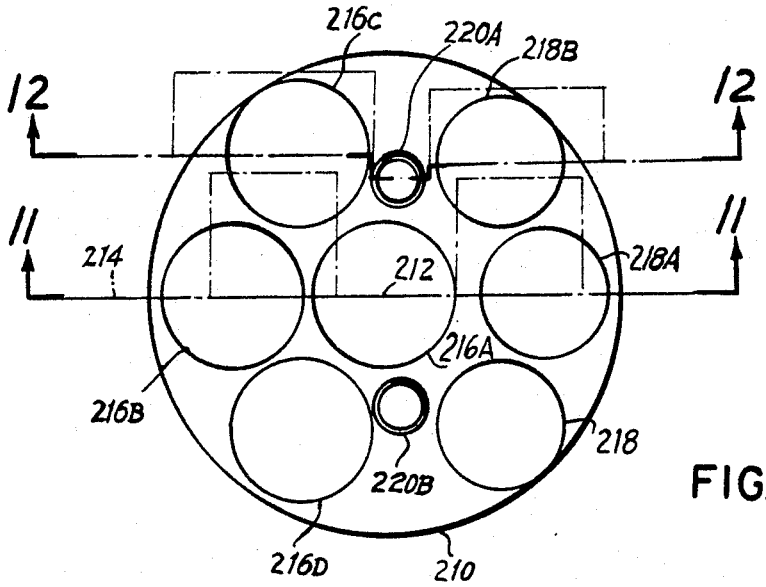

In FIG. 10, numerals 210 and 212 indicate a cylinder and the bore center of the cylinder, respectively. Numeral 214 indicates an axis of symmetry which extends through that bore center 212. Numeral 216 (e.g., 216A to 216D) indicates one of the intake valves. Of these, one intake valve 216A is positioned at bore center 212, whereas valve 216B is positioned on axis of symmetry 214. The remaining intake valves 216C and 216D are so positioned as to interpose in between intake valves 216A and 216B on axis of symmetry 214 and so as to be symmetrical with respect to that axis 214. Numeral 218 (e.g., 218A to 218C) indicates exhaust valves. Of these, one exhaust valve 218A is positioned on axis of symmetry 214 but at the side opposite from intake valve 216B, whereas the other exhaust valves 218B and 218C are so arranged as to interpose in between them exhaust valve 218A and so as to be symmetric with respect to axis of symmetry 214. Numeral 220 (e.g., 220A and 220B) indicates ignition plugs, which are arranged between the intake valves 216C and 216D and the exhaust valves 218B and 218C, respectively, and in symmetry with axis 214.

Figure 11:
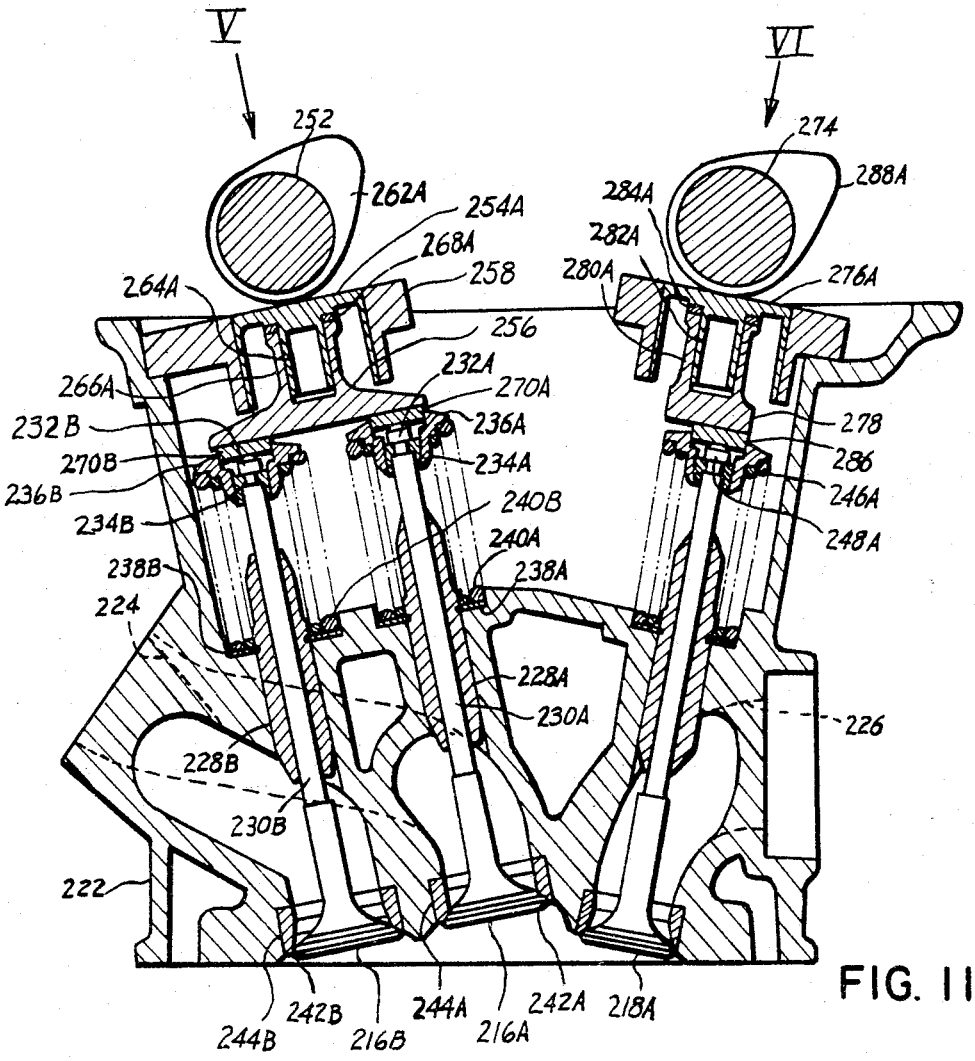
FIGS. 11 and 12 are cross-sections taken at lines 11—11 and 12—12, respectively, in FIG. 10.
Figure 12:
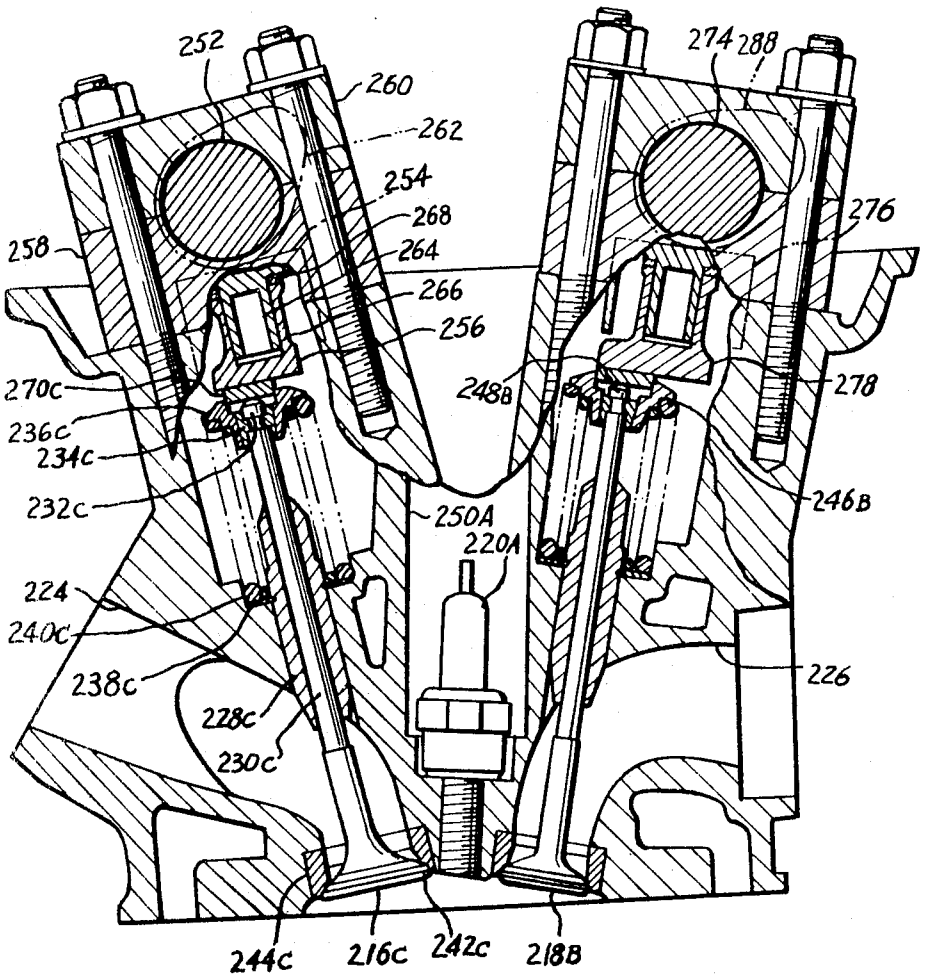

Turning now to FIGS. 11, 12, 14 and 15, numeral 222 indicates a cylinder head. This cylinder head 222 is formed with two intake passages 224 (although only one of them is shown in FIGS. 11 and 12) and two exhaust passages 226 (although only one of them is shown) respectively in symmetry with axis of symmetry 214. The two intake passages 224 are made to communicate with intake valve 216C or 216D at the same side and with the intake valves 216A and 216B on axis of symmetry 214. On the other hand, the two exhaust valves 226 are made to communicate with exhaust valve 218B or 218C at the same side and with the exhaust valve 218A on axis 214.

Figure 13:
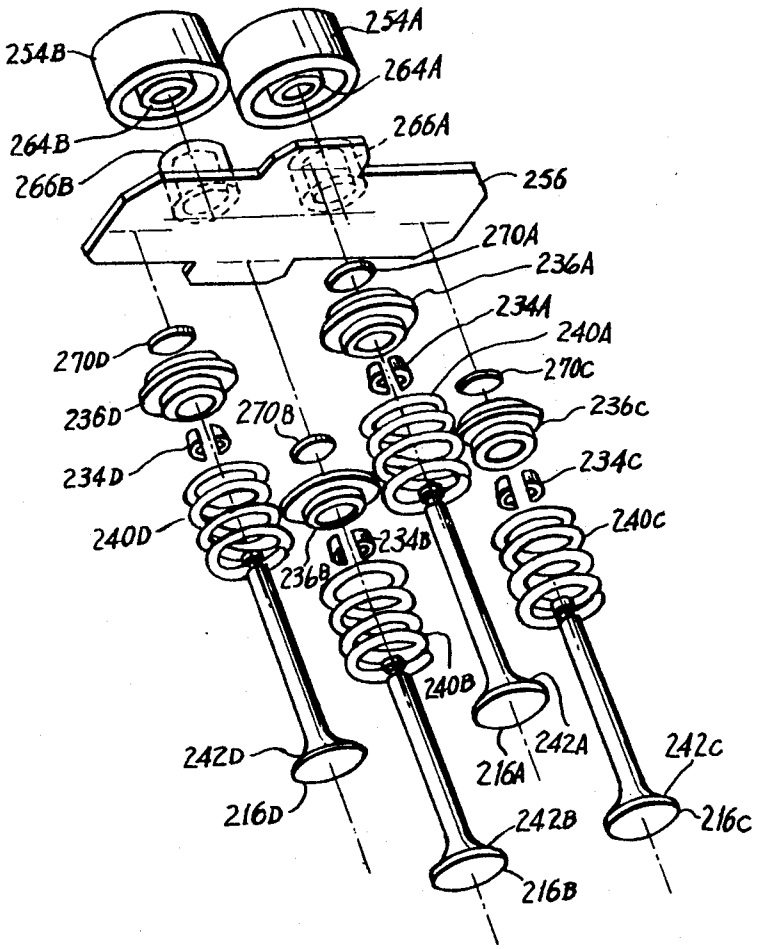
FIG. 13 is an exploded view showing a desirable feature of the invention.

The four intake valves 216A to 216D are, as best seen in FIGS. 11 and 12, parallel to one another and are inclined toward intake passages 224. They are slidably held in valve guides 228 (e.g., 228A to 228D), respectively. Valve guide 228D does not appear in FIGS. 11 and 12. On the valve stem ends 232 (e.g., 232A to 232D) of the valve stems 230 (e.g., 230A to 230D) of the respective valves 216A to 216D, as best seen in FIG. 13, there are fixed by means of split cotters 234 (e.g., 234A to 234D) retainers 236 (e.g., 236A to 236D). Between retainers 236 and retainers 238 (e.g., 238A to 238D) retained on the valve guides 228, there are sandwiched under compression valve springs 240 (e.g., 240A to 240D). By the forces of valve springs 240, valves 216 have their poppet members 242 (e.g., 242A to 242D) thrusted at their circumferential edges from the side of a combustion chamber onto valve seats 244 (e.g., 244A to 244D, although the valve seat 244D is not shown) and biased in the closed direction. Moreover, since the respective valves 216A to 216D are parallel, their valve stem ends 232A to 232D are positioned not on a straight line but two-dimensionally.

The three exhaust valves 218A to 218C are, as best seen in FIGS. 11 and 12, parallel to one another and are inclined toward the exhaust passage 226 and biased by the forces of valve springs 246 (i.e., 246A to 246C, of which the valve spring 244C is not shown) in the direction to be closed. As a result, the valve stem ends 248A to 248C (of which the end 248C is not shown) are positioned not on a straight line but two-dimensionally. Incidentally, exhaust valves 218A to 218C are constructed similarly to the aforementioned intake valves 216A to 216D, and their repeated explanations are omitted here.

Intake valves 216 and exhaust valves 218 are inclined toward the intake passages 224 and the exhaust passages 226, respectively, so that valves 216 and 218 generally form the shape of a letter "V", as seen in FIGS. 11 and 12. Between valves 216 and 218, arranged to generally form the V-shape, there are formed ignition plug guide holes 250 (e.g., 250A and 250B) (which will be seen in FIGS. 12, 14 and 15). The aforementioned ignition plugs 220A and 220B can be mounted and demounted through those guide holes 250A and 250B.

Numeral 252 indicates a cam shaft at the intake side, and numeral 254 (e.g., 254A and 254B) indicates valve lifters at the intake side. Numeral 256 indicates a thrust plate at the intake side. Cam shaft 252 is held between a bearing member 258 and a holding member 260 in a manner to intersect the aforementioned axis of symmetry 214 at a right angle, and is rotationally driven at a speed as high as one half that of a crankshaft (not shown). Cam shaft 252 is formed for each cylinder with two cams 262 (e.g., 262A and 262B) which have identical shapes. Valve lifters 254A and 254B are formed into the inverted shape of a bottom cylinder, which has its cylindrical outer circumference held slidably in bearing member 258 of cam shaft 252 so that valve lifters 254A and 254B can be moved parallel to the aforementioned intake valves 216. Valve lifters 254A and 254B are parallel to one another and are so arranged with the aforementioned cam shaft 252 that cams 262A and 262B of cam shaft 252 are in sliding contact with the top sides of valve lifters 254A and 254B. Respective valve lifters 254 are formed with cylindrical center portions 264 (e.g., 2-4A and 264B) which depend downward from the centers thereof.

Figure 14:
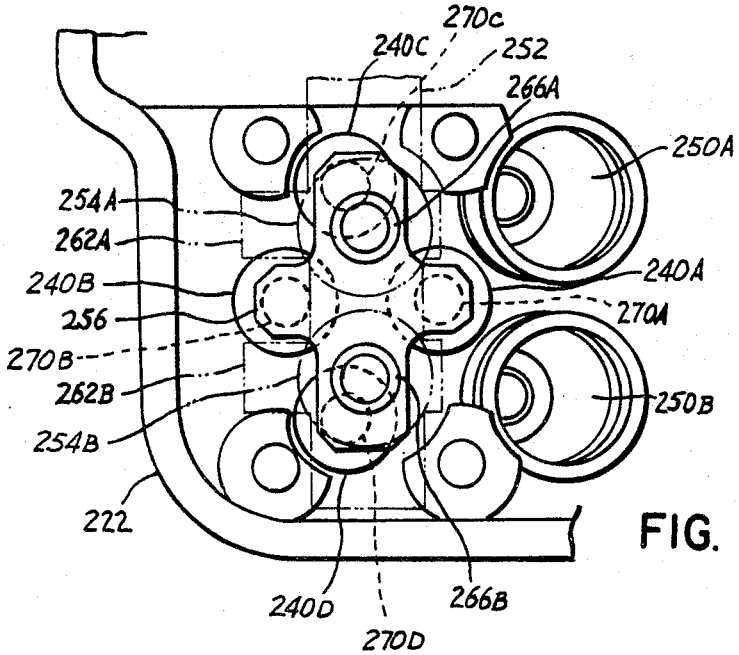
FIGS. 14 and 15 are detailed views of the construction shown in FIG. 12.

Thrust plate 256 is formed, as shown in FIG. 14, to generally have a cross shape, with cylindrical portions 266 (e.g., 266A and 266B), on its upper side which rotatably engage with the center portions 264 of the aforementioned valve lifters 254, respectively. Specifically, thrust plate 256 has its cylindrical portions 266 rotatably fitted on the outer circumferences of the center portions 264 through shims 268 (e.g., 268A and 268B), as shown in FIGS. 11 and 12, so that it can move together with the two valve lifters 254, parallel to valves 216. Those respective leg portions of thrust plate 256, which are formed into a cross shape, extend to above the respective valve stem ends 232 of the four valves 216 and are arranged to face the respective valve stem ends 232 through pads 270 (e.g., 270A to 270D), respectively. As a result, if thrust plate 256 is moved toward respective valves 216, these valves are thrusted down so that they are simultaneously opened.

Moreover, the aforementioned valve lifters 254 are slightly eccentric and parallel to cam shaft 252 with respect to the cams 262 of the cam shaft 252 so that they are rotated by the rotations of the cam shaft 252. As a result, the valve lifters 254 are prevented from being eccentrically worn. On the other hand, the respective valve lifters 254 and cam shaft 252 are so positioned that, when cams 262 thrust valve lifters 254, thrust plate 256 and the four valves 216, the reactions of the respective valves 216 by valve springs 240 are symmetrical with each other with respect to the line which joins the centers of the respective valve lifters 254. As a result, the thrust plate 256 thrusts the four valves 216 with a uniform thrust and parallel to one another, thereby to prevent any excessive force from exerted in directions to incline valve lifters 254.

Figure 15:
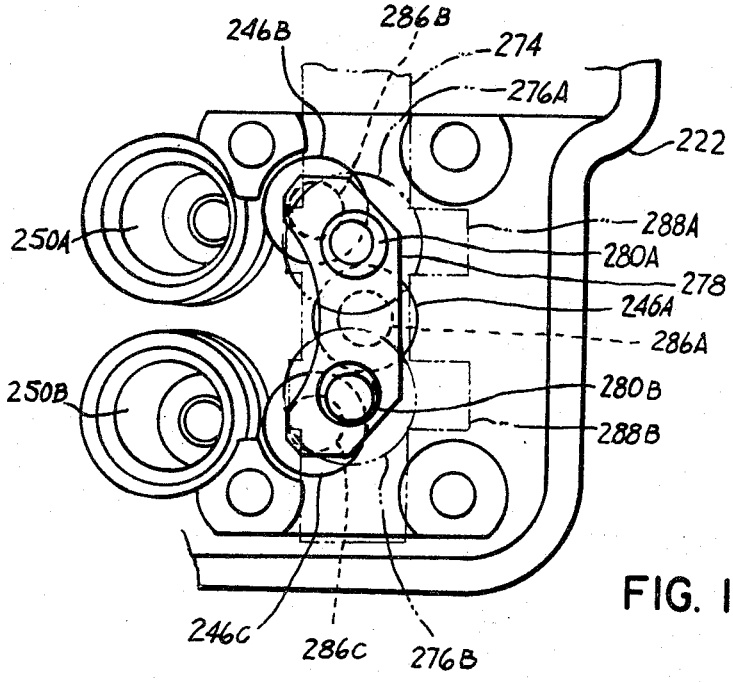

Numerals 274, 276 (e.g., 276A and 276B) and 278 indicate a cam shaft at the exhaust side, valve lifters at the exhaust side, and a thrust plate at the exhaust side, respectively. The valve actuating mechanism at the exhaust side is different from the aforementioned one at the intake side, in which four intake valves 216 are simultaneously opened and closed by the action of the single thrust plate 256, only in that instead three exhaust valves 218 are simultaneously opened and closed by the single thrust plate 278. Specifically, thrust plate 278 at the exhaust side is generally formed into an arcuate shape, as shown in FIG. 15, such that cylindrical portions 280 (e.g., 280A and 280B) formed to protrude from the upper side thereof rotatably engage with the center portions 282 (e.g., 282A and 282B, the latter of which is not shown) of valve lifters 276 through shims 284 (e.g., 284A and 284B, the latter of which is not shown) and such that its lower side faces valve stem ends 248 of respective valves 218 through pads 286 (e.g., 286A and 286B). As a result, valve shifters 276 and thrust plate 278 are thrusted downward by the actions of two cams 288 (e.g., 288A and 288B) formed on the cam shaft 274 so that thrust plate 278 can simultaneously open and close respective valves 218.

Now, at the suction stroke, if the two cams 262 of the intake side cam shaft 252 simultaneously thrust downward the respective valve lifters 254, thrust plate 256 is moved down together with valve lifters 254, thereby to uniformly and simultaneously thrust valve stem ends 232 of the four intake valves 216 downward. As a result, valve springs 240 are compressed so that the respective valves 216 are simultaneously operated to allow intake air to flow from intake passages 224 into the combustion chamber. Since valve lifters 254 are slightly eccentric and parallel to cam shaft 252 with respect to the cams 262, they are respectively rotated. However, since the thrust plate 256 is in rotatable engagement with center portions 264A and 264B which are positioned at the centers of the two valve lifters 254A and 254B, it is precluded from any rotation. Moreover, since the reactions of the respective valves 216 against thrust plate 256 are balanced with respect to the line jointing center portions 264A and 264B of the respective valve lifters 254A and 254B, no excessive force which tends to incline the valve lifters 254 is established, so that these valve lifters 254 are smoothly moved.

At the exhaust stroke, cams 288 at the exhaust side thrust downward the two valve lifters 276 and the single thrust plate 278 so that the three exhaust valves 218 are simultaneously opened.

In the embodiment thus far described, both the intake and the exhaust system are equipped with the plural valves 216A to 216D and the plural valves 218A to 218C, respectively, and these respective valves 216 and 218 are opened and closed by the single thrust plates 256 and 278, respectively. However, the present invention can naturally be applied to either of the intake system or the exhaust system.

Also in this embodiment, valve stem ends 232 and 248 of the respective valves 216 and 218 are positioned two-dimensionally with respect to cam shafts 252 and 274. However, the present invention can be applied to the situation in which the respective valve stem ends are positioned one-dimensionally, parallel to the cam shafts.

Furthermore, in this embodiment, since the respective thrust plates 256 and 278 of the intake and exhaust systems are adapted to be thrusted by the two valve lifters 254A and 254B and the two valve lifters 276A and 276B, respectively, the two cams 262 and the two cams 288 are respectively required. In accordance with the present invention, each thrust plate could be thrusted by a single valve lifter and a single cam. In this modification, the numbers of the cams and the valve lifters can be further reduced to further lighten the moving parts and accordingly to reduce the number of parts required.

As has been described hereinbefore, according to the present invention, there are sandwiched between the valve stem ends of a plurality of parallel valves, which form at least part of either the intake system or the exhaust system, and the valve lifters, which are to be thrusted toward the aforementioned valves by the actions of the cam shafts, the thrust plates which are made movable together with the aforementioned vlave lifters so that the aforementioned plural valves are simultaneously opened and closed by one of the thrust plates. As a result, since it is unnecessary to provide an independent valve for each valve and to use any rocker arm, the moving parts can be markedly lightened to provide an internal combustion engine which is suitable for the high speed running operation. Moreover, since the valve lifters are adapted to move the thrust plates, their number can be made smaller than that of the valves, and the number of cams formed on the cam shafts can also be made smaller than the number of the valves. As a result, the machining process of the cam shafts can be facilitated. Also, since no independent valve lifter is used for each valve, the gap between the two adjacent valves can be narrowed so that the internal combustion engine can be made compact. Furthermore, not only in case the respective valves are arranged one-dimensionally in parallel with the cam shafts, but also in case the plural valves are arranged two-dimensionally in directions perpendicular to the cam shafts, they can be simultaneously opened and closed according to the present invention, thereby to increase the degree of freedom for designing the valve arrangement and to provide the most proper valve arrangement for meeting the using purpose of the engine.

FIGS. 16–21 show yet another feature of the invention.

Figure 16:
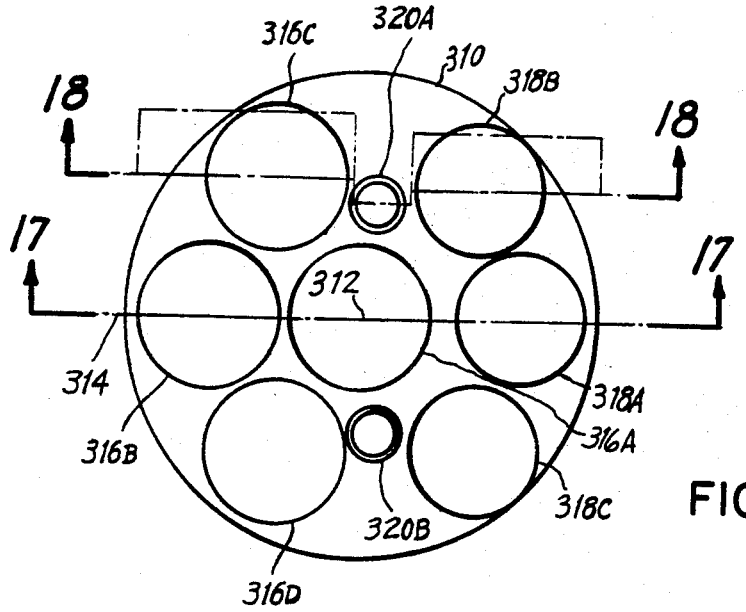
FIG. 16 is a top plan schematic view of another useful feature of the invention.

In FIG. 16, numerals 310 and 312 indicate a cylinder and the bore center of the cylinder, respectively. Numeral 314 indicates an axis of symmetry which extends through bore center 312. Numeral 316 (e.g., 316A to 316D) indicates one of intake valves. Of these, one intake valve 316A is positioned at the bore center 312, whereas valve 316B is positioned on axis of symmetry 314. The remaining intake valves 316C and 316D are so positioned as to interpose inbetween intake valves 316A and 316B on the axis of symmetry 314 and as to be symmetric with respect to axis 314. Numeral 318 (e.g., 318A to 318C) indicates exhaust valves. Of these, one exhaust valve 318A is positioned on the axis of symmetry 314 but at the side opposite from intake valve 316B, whereas the other exhaust valves 318B and 318C are so arranged as to interpose in between the exhaust valve 318A and as to be symmetrical with respect to that axis of symmetry 314. Numeral 320 (e.g., 320A and 320B) indicates ignition plugs, which are arranged between the intake valves 316C and 316D and the exhaust valves 318B and 318C, respectively, and in symmetry with axis 314.

Figure 17:
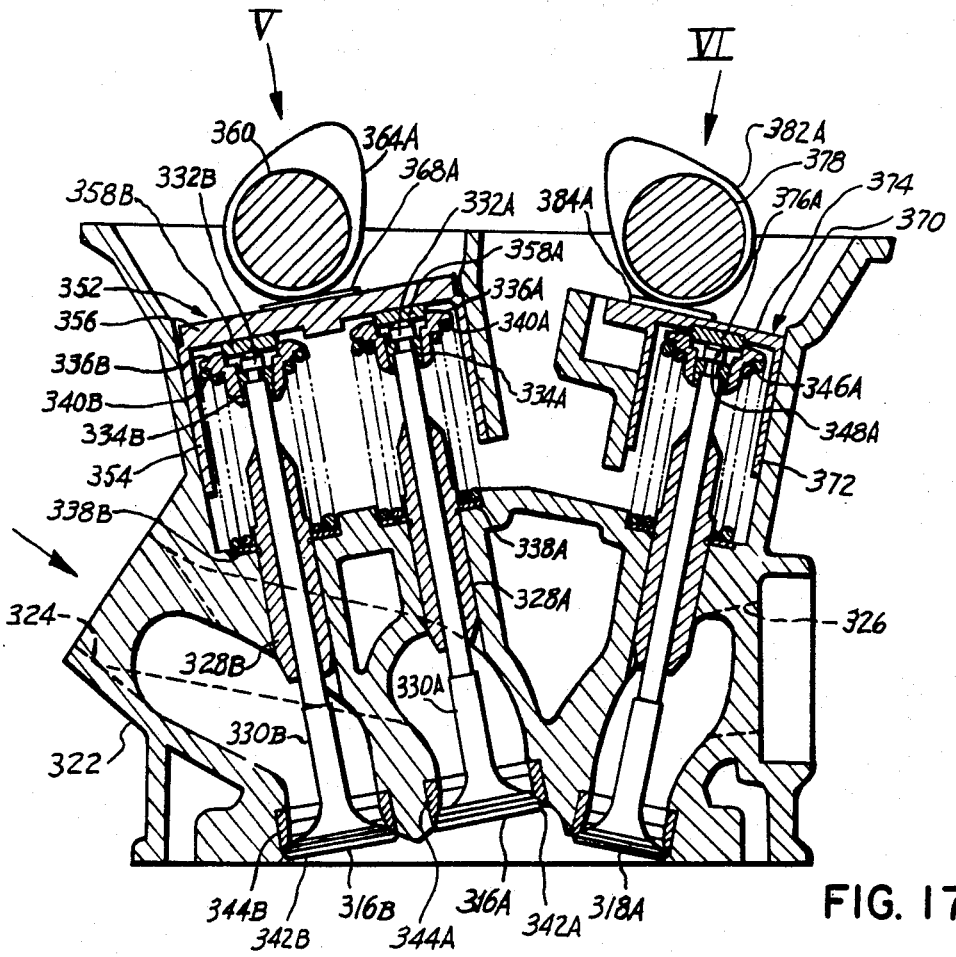
FIG. 17 is a cross-section taken at line 17—17 in FIG. 16.
Figure 18:
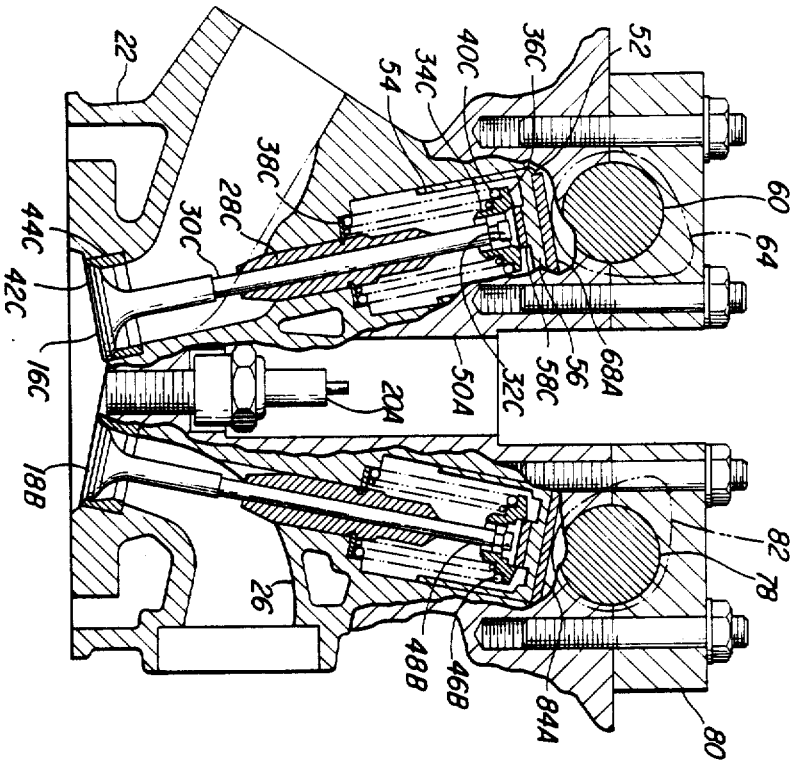
FIG. 18 is a cross-section taken at line 18—18 in FIG. 16.

Turning now to FIGS. 17, 18, 20 and 21, numeral 322 indicates a cylinder head. Cylinder head 322 is formed with two intake passages 324 (although only one of them is shown in FIGS. 17 and 18) and two exhaust passages 326 (although only one of them is shown) respectively in symmetry with axis of symmetry 314. The two intake passages 324 are made to communicate with intake valve 316C or 316D at the same side and with intake valves 316A and 316B on axis of symmetry 314. On the other hand, the two exhaust valves 326 are made to communicate with exhaust valve 318B or 318C at the same side and with exhaust valve 318A on axis 314.

Figure 19:
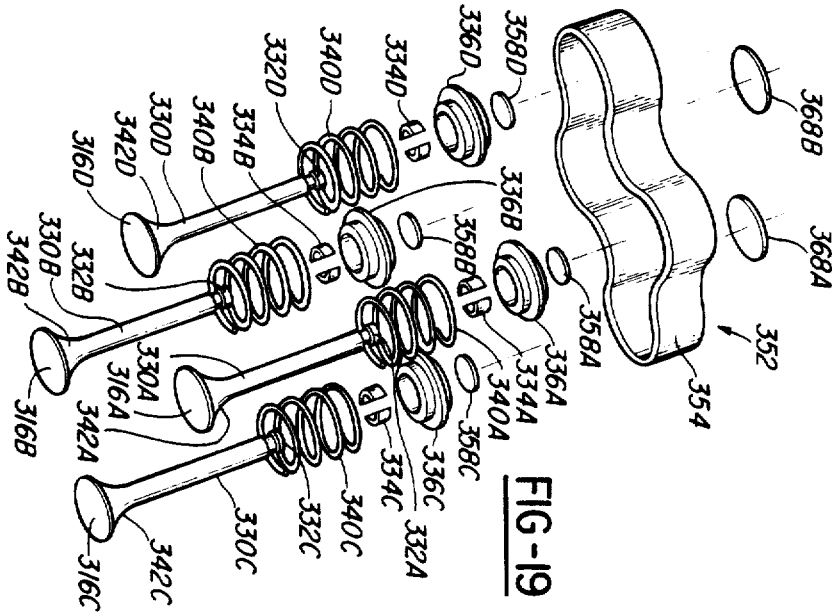
FIG. 19 is an exploded view of a portion of FIG. 18.

The four intake valves 316A to 316D are, as best seen in FIGS. 17 and 18, parallel to one another and inclined toward the intake passages 324 and slidably held in valve guides 328 (e.g., 328A to 328D), respectively. Incidentally, valve guide 328D does not appear in FIGS. 17 and 18. On valve stem ends 332 (e.g., 332A to 332D) of valve stems 330 (e.g., 330A to 330D) of the respective valves 316A to 316D, as best seen in FIG. 19, there are fixed by means of split cotters 334 (e.g., 334A 334D) retainers 336 (e.g., 336A to 336D). Between these retainers 336 and retainers 338 (e.g., 338A to 338D) retained on valve guides 328, there are sandwiched under compression valve springs 340 (e.g., 340A to 340D). By the forces of valve springs 340, valves 316 have their poppet members 342 (e.g., 342A to 342D) thrusted at their circumferential edges from the side of a combustion chamber onto valve seats 344 (e.g., 344A to 344D, although valve seat 344D is not shown) and biased in the direction to be closed. Moreover, since the respective valves 316A to 316D are parallel to one another, their valve stem ends 332A to 332D are positioned not on a straight line but two-dimensionally.

The three exhaust valves 318A to 318C are, as best seen in FIGS. 17 and 18, parallel to one another and inclined toward exhaust passage 326 and biased by the forces of valve springs 346 (i.e., 346A to 346C, of which valve spring 344C is not shown) in the direction to be closed. As a result, valve stem ends 348A to 348C (of which head 348C is not shown) are positioned not on a straight line but two-dimensionally. Exhaust valves 318A to 318C are constructed similarly to the aforementioned intake valves 316A to 316D, and their repeated explanations are omitted here.

Intake valves 316 and exhaust valves 318 are inclined toward intake passages 324 and exhaust passages 326, respectively, so that valves 316 and 318 generally form a shape of letter "V", as seen from FIGS. 17 and 18. Between valves 316 and 318, arranged to generally form the V-shape, there are formed ignition plug guide holes 350 (e.g., 350A and 350B) (see FIGS. 18, 20 and 21). The aforementioned ignition plugs 320A and 320B can be mounted and demounted through guide holes 350A and 350B.

Figure 20:
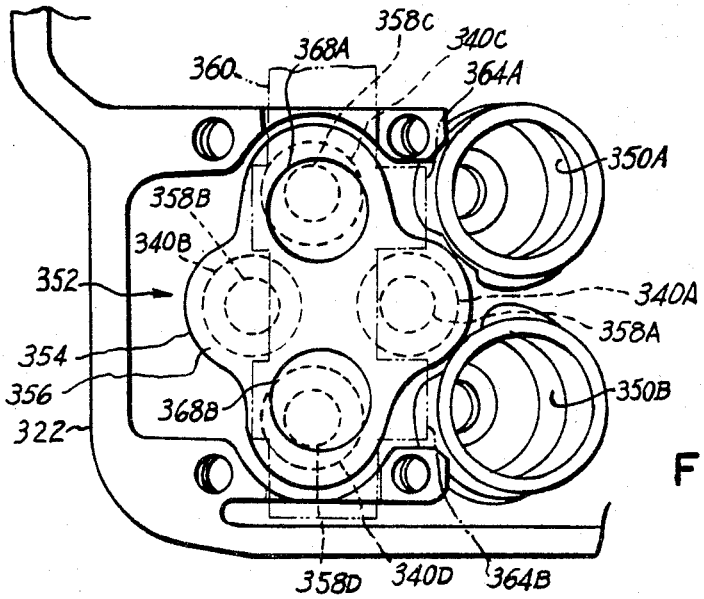
FIGS. 20 and 21 are views of portions of FIG. 18.
Figure 21:
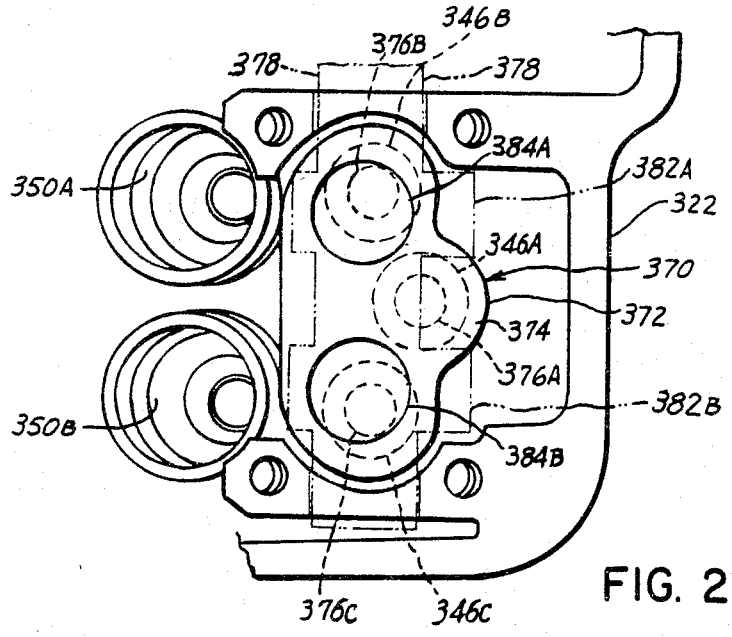

Numeral 352 indicates a valve lifter at the intake side. Valve lifter 352 is constructed, as shown in FIGS. 19 and 20, to include a side plate portion 354, which covers the sides of respective valve springs 340A to 340D at the side of valve stem ends 332A to 332D, and an upper plate portion 356, which closes the upper opening of the side plate portion, and is wholly formed into such a cover shape that its generally diamond-shaped top plane view has its respective sides curved inwardly. Valve lifter 352 has its side plate portion 354 guided by cylinder head 322, as shown in FIGS. 17 and 18, so that it can slide in the same direction as valves 316. The inner (or lower) side of upper plate portion 356 of valve lifter 352 faces valve steam ends 332A to 332D of respective valves 316A to 316D through pads 358A to 358D, respectively.

Numeral 360 indicates an overhead cam shaft at the intake side. This cam shaft 360 is rotatably held between cylinder head 322 and holding member 362 (as shown in FIG. 18) in a manner to intersect the aforementioned axis 314 of symmetry (as shown in FIG. 16) at a right angle and can rotate in synchronism with the crankshaft (although not shown) and at a speed as high as one half of the same. Cam shaft 60 is formed for each cylinder with two cams 364 (e.g., 364A and 364B) having an identical shape, which are in abutment contact with the upper side of upper plate portion 356 of the aforementioned valve lifter 352 through pads 368 (e.g., 368A and 368B). Pads 368 are rotatably placed in recesses (all shown in FIG. 18), which are formed in the upper side of upper plate portion 356 of valve lifter 352, and are slightly eccentric and parallel to cam shaft 360 from the respective cams 364. As a result, when the cam surfaces of cams 364 are brought into sliding engagement with pads 368 by the rotation of cam shaft 360, the pads 368 are rotated. Cam shaft 360 is so positioned that, when cams 364A and 364B thrust valve lifters 352 and the respective valves 316, the reactions of the respective valves 316 become symmetrical with respect to the line joining the contacting portions between cams 364A and 364B and pads 368A and 368B, respectively. As a result, valve lifter 352 thrusts the respective valves 316 in parallel with a uniform thrusting force so that no excessive force is established in a direction likely to incline valve lifter 352.

Numeral 370 indicates a valve lifter at the exhaust side. Valve lifter 370 is constructed, similarly to the aforementioned valve lifter 352 at the intake side, to include a side plate portion 372, which covers respective valve springs 346A to 346C at the side of valve stem ends 348A to 348C, and an upper plate portion 374 which is formed to close the upper opening of side plate prevented from being eccentrically worn. Moreover, since the reactions of the respective valves 316 are balanced with respect to the line joining the contacting portions between cams 364 and pads 368, such an excessive force as would incline valve lifter 352 is not exerted upon the same so that value lifter 352 can smoothly move.

At the exhaust stroke, cams 382 likewise thrust valve lifter 370 through pads 384 so that the three exhaust valves 318 are simultaneously opened.

In the embodiment being described, both the intake and the exhaust system are equipped with plural valves 316A to 316D and plural valves 318A to 318C, respectively, and these respective valves 316 and 318 are opened and closed at one time by valve lifters 352 and 370, respectively. However, the present invention can of course be applied to either the intake system or to the exhaust system. In this embodiment, moreover, although valve stem ends 332 and 348 of the respective valves 316 and 318 are positioned two-dimensionally with respect to cam shafts 360 and 378, the present invention can also be applied to the situation in which the respective valve stem ends are positioned below and in parallel with the cam shafts, namely, in which they are positioned one-dimensionally.

In the instant embodiment, furthermore, although the respective valve lifters 352 and 370 of the intake and exhaust systems are thrusted by the two cams 364A and 364B and the two cams 382A and 382B, respectively, a single valve lifter may be thrusted by a single cam.

As has been described hereinbefore, according to the instant feature, at least either of the intake system or the exhaust system is composed of a plurality of parallel valves, and portion 372, and is formed as a whole to cover the upper ends of the respective valves 318A to 318C. Valve lifter 370 has its side plate portion 372 guided by cylinder head 322 so that it can slide toward the respective valves 318. The lower (or inner) side of upper plate portion 374 faces valve stem ends 348A to 348C of the respective valves 318A to 318C through pads 376 (e.g., 376A to 376C).

Numeral 378 indicates an overhead cam shaft at the exhaust side, which is rotatably held between cylinder head 322 and a holding member 380 (as shown in FIG. 18) parallel to the aforementioned cam shaft 360 at the intake side, such that it can rotate at the same speed as that of the aforementioned cam shaft 360. Cam shaft 378 is formed for each cylinder with two cams 382 (e.g., 383A and 383B), which are made operative to thrust the valve lifter 370 through pads 384 (e.g., 384A and 384B) rotatably placed on the upper side of the upper plate portion 374. It is similar to the case of the aforementioned cam shaft 360 at the intake side that pads 384 are slightly eccentric with respect to cams 382 and that cam shaft 378 is so positioned that the thrusting forces upon the respective valves 318 become symmetric with respect to the line joining the contacting portions between the respective cams 382 and the respective pads 384.

Now, at the suction stroke, if cams 364 of cam shaft 360 at the intake side thrust downward the valve lifter 352 through pads 368, valve lifter 352 thrusts downward the valve stem ends 332 of respective valves 316 uniformly and simultaneously through pads 358. As a result, valve springs 340 are compressed so that valves 316 are opened to allow intake air to be sucked from intake passages 324 into the combustion chamber. Since pads 368, with which cams 364 are in sliding engagement, are rotated at a lower speed in accordance with the rotations of cams 364, they are valve lifters for simultaneously thrusting the valve stem ends of these plural valves which are slidably held in the cylinder head and thrusted toward the valves by the corresponding cam shafts. As a result, the aforementioned plural valves can be opened and closed at one time by a single valve lifter. As a result, since it becomes unnecessary to provide independent valve lifters for each valve and since no rocker arm is used, the moving parts can be remarkably lightened to ensure the high speed running operation. Furthermore, since a single valve lifter is required for the aforementioned plural valves, it is sufficient to form the cam shaft with a smaller number of cams than of valves, thereby to facilitate the machining process for manufacturing the cam shaft. Furthermore, since independent valve lifters are not provided for the respective valves, the gaps between any two adjacent valves can be narrowed to make the engine compact, and the respective valves can be arranged two-dimensionally, thereby to increase the degree of freedom for designing the valve arrangement and to provide the most proper valve arrangement for meeting the objctives of the engine.

FIGS. 22–25 illustrate yet another feature of the invention.

Figure 22:
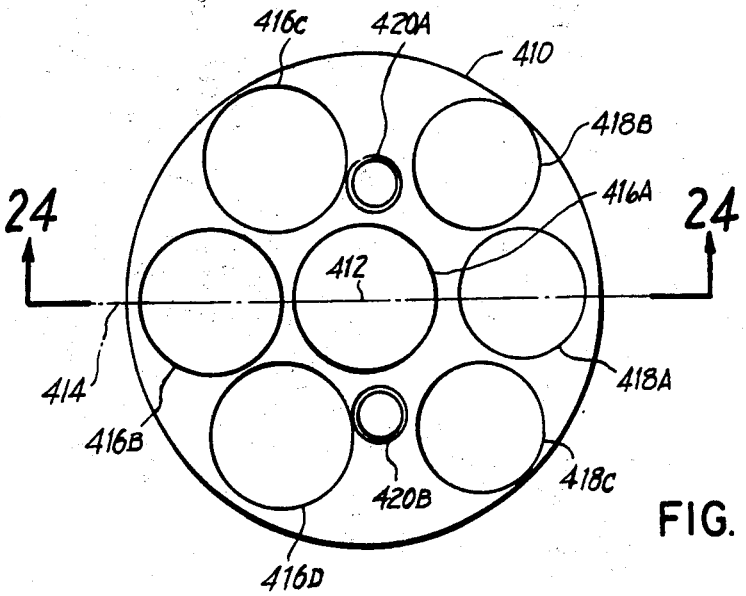
FIG. 22 is a top plan schematic view of another useful feature.
Figure 23:
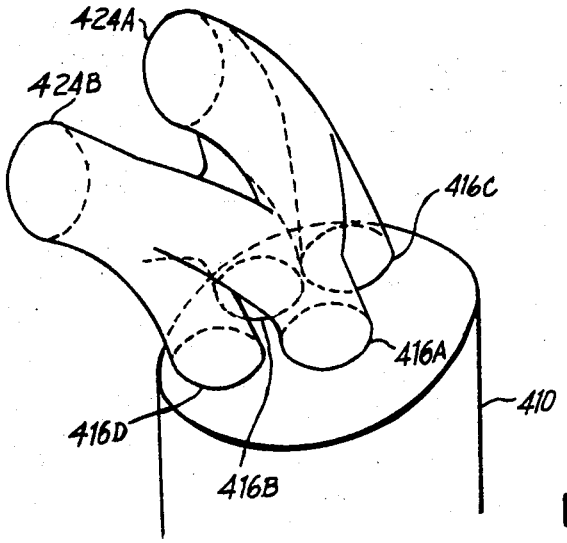
FIG. 23 is a fragmentary perspective view of a feature useful with the cylinder of FIG. 22.

In FIG. 22, numerals 410 and 412 indicate a cylinder and the bore center of the cylinder, respectively. Numeral 414 indicates an axis of symmetry which extends through bore center 412. Numeral 416 (e.g., 416A to 416D) indicates intake valves. Of these, one intake valve 416A is positioned at bore center 412, whereas valve 416B is positioned on axis of symmetry 414. The remaining intake valve 416C and 416D are so positioned as to interpose in between intake valves 416A and 416B on axis of symmetry 414 and so as to be symmetric with respect to axis 414. Numeral 418 (e.g., 418A to 418C) indicates exhaust valves. Of these, one exhaust valve 418A is positioned on axis of symmetry 414 but at the side opposite from intake valve 416B, whereas the other exhaust valves 418B and 418C are so arranged as to interpose in between exhaust valve 418A and as to be symmetrical with respect to axis of symmetry 414. Numeral 420 (e.g., 420A and 420B) indicates ignition plugs, which are arranged between intake valves 416C and 416D and exhaust valves 418B and 418C, respectively, and in symmetry with axis 414.

Figure 24:
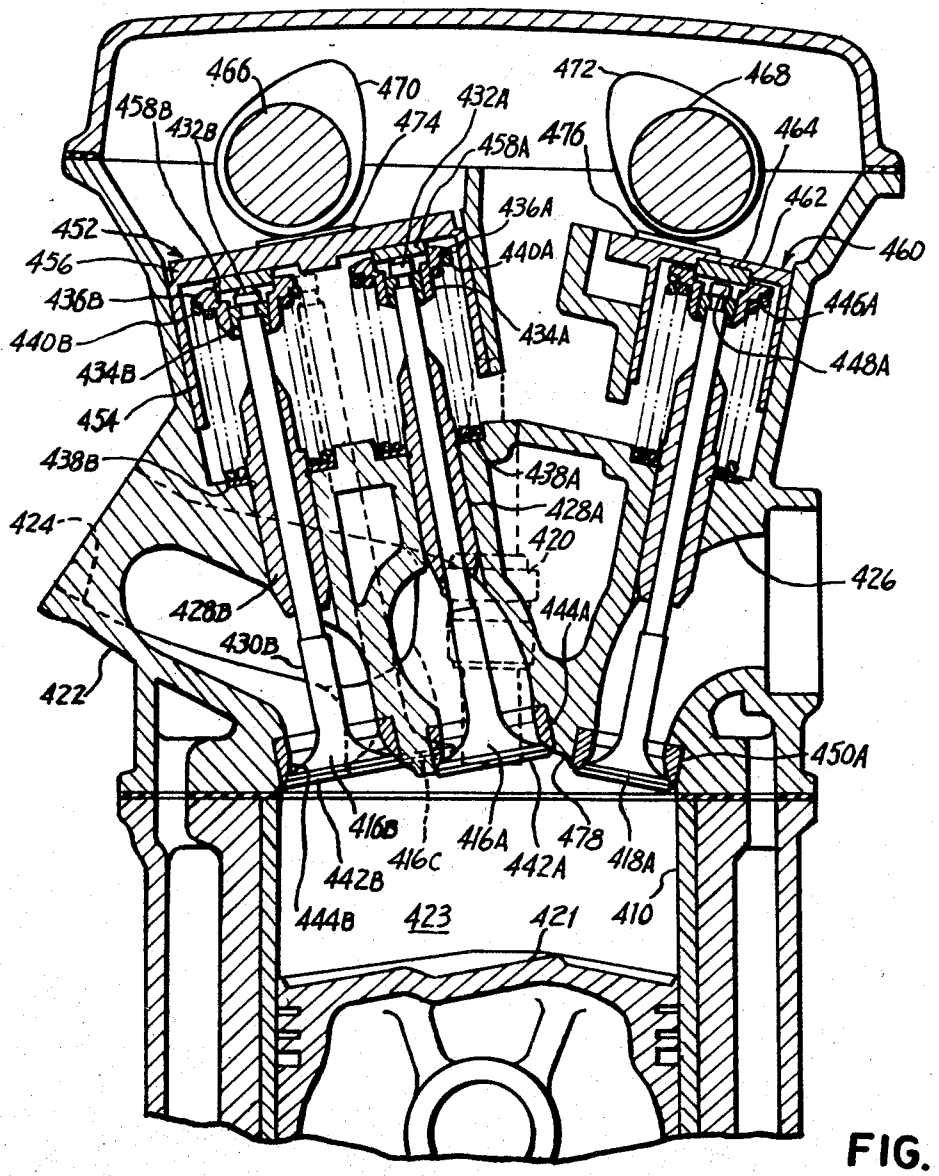
FIG. 24 is a cross-section taken at line 24—24 in FIG. 22.

In FIG. 24, numerals 421, 422 and 423 indicate a piston which is slidable in cylinder 410, a cylinder head and a combustion chamber, respectively. Cylinder head 422 is formed with two intake passages 424 (e.g., 424A and 424B) (see FIG. 23), which are branched in cylinder head 422 until they communicate with intake valve 416C or 416D at the same side thereof and with intake valves 416A and 416B on axis of symmetry 414. Exhaust passages 426 communicate with exhaust valves 418A to 418C.

Figure 25:
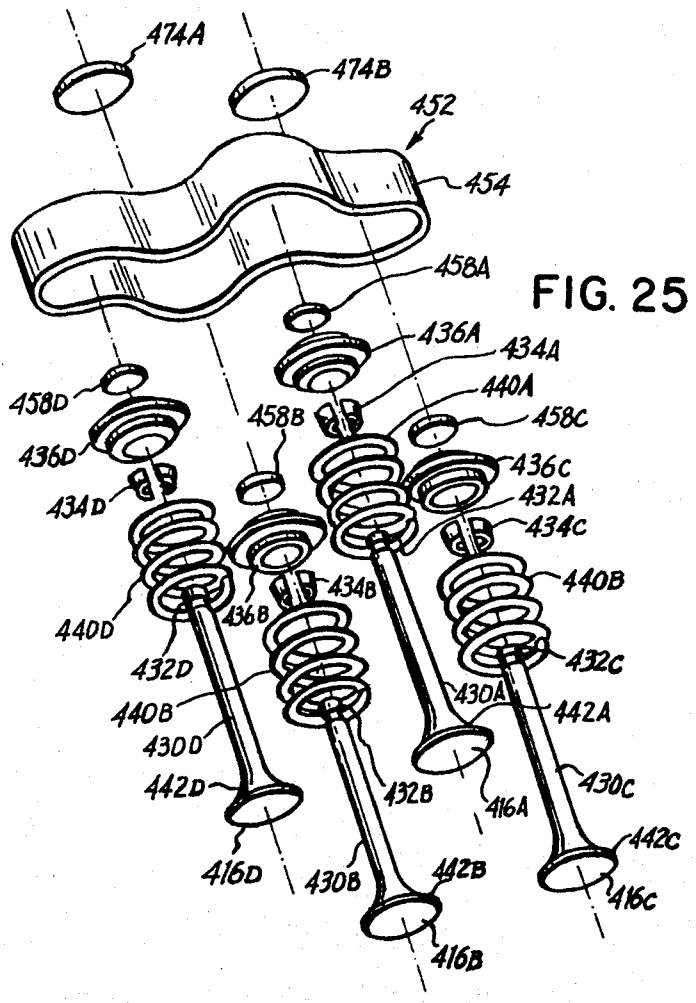
FIG. 25 is an exploded view of a portion of FIG. 24.

The four intake valves 416A to 416D are parallel to one another and inclined, as best seen in FIGS. 24 and 25, toward intake passages 424, and are slidably held in valve guides 428 (of which only the valve guides 428A and 428B are shown), respectively. On valve stem ends 432 (e.g., 432A to 432D) of the respective valves 416, as best seen in FIG. 25, there are fixed by means of split cotters 434 (e.g., 434A to 434D) retainers 436 (e.g., 436A to 436D). Between retainers 436 and retainers 438 (e.g., 438A to 438D, of which retainers 438A and 438B are shown), there are sandwiched under compression valve springs 440 (e.g., 440A to 440D). By the forces of these valve springs 440, valves 416 have their poppet members 442 (e.g., 442A to 442D) thrusted at their circumferential edges 444 from the side of the combustion chamber 423 so that they are biased in the direction to be closed.

Of the four intake valves 416, valve 416A at the bore center 412 has its valve stem 430A made longer than valve stems 430B to 430D of the remaining valves 416B to 416D, and its valve seat 444A is correspondingly disposed more into the combustion chamber 423 (measured parallel with valve stems 430) then the remaining valve seats 444B to 444C. Specifically, the respective valve stems 430A to 430D have not only their stem ends 432A to 432D but also their poppet members 442B to 442C positioned in a plane which is normal to respective valve stems 430. However, valve stem 430A of valve 416A is longer than the remaining valve stem 430B to 430D so that the corresponding valve set 444A protrudes more deeply by a length corresponding to the difference in the length among the valve stems 430 than the remaining valve seats 444B to 444D. As a result, combustion chamber 423 is made shallower in the vicinity of the bore center.

The three exhaust valves 418 are parallel to one another and inclined toward exhaust passages 426, and are biased by the actions of valve springs 446 (e.g., 446A to 446C, of which only valve spring 446A is shown), respectively, in directions to be closed so that their valve stem ends 448 (e.g., 448A to 448C, of which only valve stem end 448A is shown) lie in an identical plane which is normal to the respective valves 418. Incidentally, numeral 450 (e.g., 450A to 450C, although only the valve seat 450A is likewise shown) indicates valve seats of the exhaust valves 418.

Intake valves 416 and exhaust valves 418 are inclined toward the intake passages 424 and the exhaust passages 426, respectively, so that those valves 416 and 418 generally form a shape of a letter "V", as seen in FIG. 24. In this V-shaped space, there are formed ignition plug guide holes (although not shown), through which the aforementioned ignition plugs 420 are mounted and demounted.

Numeral 452 indicates a valve lifter at the intake side, which is constructed, as shown in FIG. 25, to include a side plate portion 454 and an upper plate portion 456 and is wholly formed into a cover shape generally having a diamond-shaped top plan view. Valve lifter 452 has its side plate portion 454 guided by cylinder head 422, as shown in FIG. 24, so that it can slide in the same direction as the valves 416. The inner (or lower) side of upper plate portion 456 of valve lifter 452 faces the valve stem 432 of the respective valves 416 through pad 458 (e.g., 458A to 458D), respectively.

Numeral 460 indicates a valve lifter at the exhaust side. Valve lifter 460 is formed into a cover shape so as to cover valve stem ends 448A to 448C of exhaust valves 418 and is guided by the cylinder head so that it can slide parallel to valves 418. Valve lifter 460 has its upper plate portion 462 faced at its inner side by valve stem ends 448 through pads 464 (e.g., 464A to 464C, although only the pad 464A is shown).

Numerals 466 and 468 indicate overhead cam shafts at the intake and exhaust sides, respectively, both of which are so rotatably held in the cylinder head 422 as to intersect the aforementioned axis of symmetry 414 (as shown in FIG. 22) at a right angle so that they can rotate in synchronism with the crankshaft (although not shown) at a speed as high as one half of the same. Cam shafts 466 and 468 are formed with two cams 470 and two cams 472, respectively, both of which abut against the upper sides of the aforementioned valve lifters 452 and 472 through pads 474 (e.g., 474A and 474B) and pads 476, respectively. Incidentally, pads 474 and 476 are slightly eccentric in the longitudinal direction of cam shafts 466 and 468 with respect to cams 470 and 472 and are rotated at a lower speed in accordance with the rotations of cams 470 and 472 thereby to prevent eccentric wear of cams 470 and 472. Moreover, cam shafts 466 and 468 and cams 470 and 472 are so positioned that, when cams 470 and 472 thrust the valve lifters 452 and 460, the reactions of the respective valves 416 and 418 become symmetrical with respect to the contacting portions between cams 470 and 472 and pads 474 and 476. As a result, valve lifters 452 and 460 thrust respective valves 416 and 418 in parallel and with uniform thrusting forces so that no excessive force is established in a direction tending to incline the valve lifters 452 and 460.

Now, at the suction stroke, if cams 470 of intake side cam shaft 466 thrust downward the valve lifter 452 through pads 474, the respective valves 416 are simultaneously and uniformly thrusted downward so that their poppet members 442 are brought out of contact with valve seats 444 until they are opened. At this time, piston 421 enters into its downward stroke so that intake air flows into combustion chamber 423 from intake passages 424. Since both valve seat 444A and poppet member 442A of valve 416A in the vicinity of bore center 412 protrude more in combustion chamber 423 than valve seats 444B to 444D and poppet members 442B to 442D of the remaining valves 416B to 416D, the step between valve seat 444A and valve seats 450 of the three exhaust valves 418 adjacent thereto, that is to say, the difference in the depth of the combustion chamber at the closest portion 478 (as shown in FIG. 24) between valve seats 444 and 450 is small. As a result, intake air flowing from intake valve 416A into combustion chamber 423 is not blocked by the step in the vicinity of that closest portion 478 but can smoothly enter combustion chamber 423. In other words, the masking effect of the intake air due to the step, if any, in the vicinity of that closest portion 478 can be lessened to improve the suction efficiency.

Moreover, since combustion chamber 423 is shallower in the vicinity of intake valve 416A, the compression ratio can be raised, and the S/V ratio (i.e., the ratio of the surface area to the volume of the combustion chamber) can be reduced, thereby to improve the thermal efficiency.

If sparks are generated by ignition plugs 420 after the compression stroke, the resulting flame will propagate within the combustion chamber 423. Thanks to the little step in the vicinity of the aforementioned closest portion 478, the flame is hardly blocked by that step and can smoothly propagate so that irregularities in the combustion for each cycle do not tend to occur. Consequently since the irregular combustion is reluctant to occur, the engine can be run with a far leaner air-fuel mixture, and the aforementioned rise in compression ratio and reduction in S/V ratio can contribute to outstanding improvement in the fuel economy. Moreover, the exhaust gas can be clarified as a result of the use of the lean mixture.

At the exhaust stroke, valve lifter 460 is thrusted downward by cams 472 of cam shaft 468 so that exhaust valves 418 are opened. Valve seats 450 are heated to a high temperature because they are exposed to the hot exhaust gas. However, since the step at the aforementioned closest portion 478 in which the respective exhaust valves 418 are arranged close to intake valve 416A, cylinder head 422 is prevented from protruding with a small thickness into combustion chamber 423 at the side of intake valve 416A of valve seats 450. As a result, the heat transferability of valve seats 450 at the side of intake valve 416A to cylinder heat 422 is improved. In addition, thermal strain is reluctant to occur both at the portions of the cylinder head 422 surrounding valve seats 450 and at valve seats 450 so that these parts can have enhanced durability.

Although, in the instant feature, only intake valve 416A is elongated while the remaining valves 416B to 416D have an identical length, it is sufficient to make shortest the valve 416B close to the inclined direction (i.e., leftwardly of FIG. 24) of valves 416 and to gradually elongate the remaining valves 416C (or 416D) and 416A located at the side opposite to the inclined direction so that their poppet members 442B, 442C (or 442D) and 442A are stepwise positioned.

As has been described hereinbefore, according to this feature, since the valve seat of the intake valve in the vicinity of the bore center is most offset inwardly of the combustion chamber and parallel to the corresponding valve stems than the valve seats of the remaining intake valves, the combustion chamber can be made shallower in the vicinity of the bore center so that fuel economy can be improved while exhaust gas is clarified as the resultant effects of a rise in the compression ratio, the reduction in the S/V ratio, and the improvement in combustion. Moreover, since the intake valve in the vicinity of the bore center hardly receives the masking effect in the vicinity of the valve seats of the exhaust valves adjacent thereto, the suction efficiency can be further improved. Furthermore, since the cooling efficiency of the valve seats of the exhaust valves and the strength of the cylinder head in the vicinity of those valve seats are improved, the thermal deformation in the vicinity of those valve seats is lessened so that the durability can be improved.

This invention is not to be limited by the embodiments shown in the drawings and described in the description, which are given by way of example and not of limitation, but only in accordance with the scope of the appended claims.

I claim:

1. An internal combustion engine having a cylinder bore having an axis, a cylinder head forming a closure for one end of said cylinder bore, a first poppet-type intake valve reciprocally supported by said cylinder head and having its head portion intersected by said cylinder bore axis when said first intake valve is closed, a second poppet-type intake valve reciprocally supported by said cylinder head and having its head portion lying on one side of a plane containing said cylinder bore axis when said second intake valve is closed, intake passage means formed in said cylinder head and controlled by said first and second intake valves for supplying a charge to said cylinder bore, a spark plug carried by said cylinder head and having its gap disposed contiguous to said plane, said intake valves having their stems inclined at an angle to said plane diverging therefrom for providing an open area to clear said spark plug, each of the poppet-type valves further having the ends of their respective valve stems lying within an axial extension of the cylinder bore.

2. An internal combustion engine according to claim 1 wherein the first and second poppet-type intake valves reciprocate along lines of action that are parallel to each other.

3. An internal combustion engine according to claim 1 further including first and second poppet-type exhaust valves reciprocally supported by the cylinder head and having their heads lying on the opposite side of the plane when said exhaust valves are closed, the stems of said exhaust valves being inclined to the plane in the opposite direction from the inclination of the intake valve.

4. An internal combustion engine according to claim 3 wherein the spark plug is disposed between the second of the intake valves and the first of the exhaust valves.

5. An internal combustion engine according to claim 4 further including a second spark plug, the first spark plug lying on the plane and the second spark plug also lying on the plane on the opposite side of the first intake valve.

6. An internal combustion engine according to claim 1 further including a third poppet-type intake valve reciprocally supported by said cylinder head and having its head portion lying on the one side of the plane containing the cylinder bore axis when said third intake valve is closed.

7. An internal combustion engine according to claim 6 wherein the valve stems of the intake valves are all parallel to each other.

8. An internal combustion engine according to claim 7 further including first and second poppet-type exhaust valves reciprocally supported by the cylinder head and having their heads lying on the opposite side of the plane when said exhaust valves are closed.

9. An internal combustion engine according to claim 6 wherein the intake valves are all operated by a common actuator engaged with their tip ends.

10. An internal combustion engine having a cylinder bore having an axis, a cylinder head forming a closure for one end of said cylinder bore, a first poppet-type intake valve reciprocally supported by said cylinder head and having its head portion intersected by said cylinder bore axis when said first intake valve is closed, a second poppet-type intake valve reciprocally supported by said cylinder head and having its head portion lying on one side of a plane containing said cylinder bore axis when said second intake valve is closed, intake passage means formed in said cylinder head and controlled by said first and second intake valves for supplying a charge to said cylinder bore comprising a first intake passage having a first inlet end disposed in an outer surface of said cylinder head and extending to said first and second intake valves and a second intake passage having a second inlet end formed in an outer face of said cylinder head spaced and separate from said first inlet end and extending to one of the first and second intake valves, but not the other thereof, a spark plug carried by said cylinder head and having its gap disposed contiguous to said plane, said intake valves having their stems inclined at an angle to said plane diverging therefrom for providing an open area to clear said spark plug.

11. An internal combustion engine having a cylinder bore having an axis, a cylinder head forming a closure for one end of said cylinder bore, first and second intake valves supported for reciprocation in said cylinder head for controlling the flow through respective first and second intake valve seats, a first intake passage having a first inlet opening formed in an outer face of said cylinder head and extending to each of said intake valve seats for delivering a charge to said cylinder bore through both of said first and second intake valves, and a second intake passage having a second inlet opening formed in an outer face of said cylinder head, spaced and separate from said first inlet opening and extending to said first intake valve seat, but not to said second intake valve seat for delivering a charge to said cylinder bore past said first intake valve, but not past said second intake valve.

12. An internal combustion engine according to claim 11 wherein the first intake valve is positioned with its valve head intersected by the cylinder bore axis when said first intake valve is closed.

13. An internal combustion engine having a cylinder bore having an axis, a cylinder head forming a closure for one end of said cylinder bore, first and second intake valves supported for reciprocation in said cylinder head for controlling the flow through respective first and second intake valve seats, a first intake passage having an inlet opening formed in an outer face of said cylinder head and extending to each of said intake valve seats for delivering a charge to said cylinder bore through both of said first and second intake valves, a second intake passage having an inlet opening formed in an outer face of said cylinder head and extending to said first intake valve seat, but not to said second intake valve seat for delivering a charge to said cylinder bore past said first intake valve, but not past said second intake valve, said first intake valve being positioned with its valve head intersected by the cylinder bore axis when said first intake valve is closed, and a third intake valve reciprocally supported in said cylinder head and controlling the flow through a third intake valve seat, said second intake passage extending to said third intake valve seat for delivering a charge to the cylinder bore through said first and said third intake valves.

14. An internal combustion engine according to claim 13 wherein the second and third intake valves lie on opposite sides of a plane containing the cylinder bore axis.

15. An internal combustion engine according to claim 14 further including a pair of exhaust valves reciprocally supported in the cylinder head and lying on opposite sides of the plane and on opposite sides of a perpendicular plane containing the cylinder bore axis from the second and third intake valves.

* * * * *

UNITED STATES PATENT AND TRADEMARK OFFICE

CERTIFICATE OF CORRECTION

PATENT NO. : 4,658,780

DATED : April 21, 1987

INVENTOR(S) : YUKIHARU HOSOI

It is certified that error appears in the above-identified patent and that said Letters Patent is hereby corrected as shown below:

Insert figures 18 and 19 as shown on the attached sheet.

Add new sheet 9 of the drawings which should be Sheet 9 of 12 and renumber the remaining sheets as follows:

Sheet 1 of 11 should be 1 of 12
Sheet 2 of 11 should be 2 of 12
Sheet 3 of 11 should be 3 of 12
Sheet 4 of 11 should be 4 of 12
Sheet 5 of 11 should be 5 of 12
Sheet 6 of 11 should be 6 of 12
Sheet 7 of 11 should be 7 of 12
Sheet 8 of 11 should be 8 of 12
Sheet 9 of 11 should be 10 of 12
Sheet 10 of 11 should be 11 of 12
Sheet 11 of 11 should be 12 of 12

Signed and Sealed this

Thirteenth Day of October, 1987

*Attest:*

*Attesting Officer*

DONALD J. QUIGG

*Commissioner of Patents and Trademarks*